US005620824A

United States Patent [19]

Okado et al.

[11] Patent Number: 5,620,824

[45] Date of Patent: Apr. 15, 1997

[54] TONER, DEVELOPER AND IMAGE FORMING METHOD

[75] Inventors: Kenji Okado, Yokohama; Akihiko Nakazawa, Kanagawa-ken; Ryoichi Fujita, Kawasaki; Makoto Kanbayashi, Yokohama, all of Japan

[73] Assignee: Canon Kabushiki Kaisha, Tokyo, Japan

[21] Appl. No.: 272,507

[22] Filed: Jul. 7, 1994

Related U.S. Application Data

[63] Continuation of Ser. No. 728,264, Jul. 11, 1991, abandoned.

[30] Foreign Application Priority Data

| | | | |
|---|---|---|---|
| Jul. 12, 1990 | [JP] | Japan | 2-182670 |
| Jul. 25, 1990 | [JP] | Japan | 2-194978 |
| Jul. 30, 1990 | [JP] | Japan | 2-199253 |
| Jul. 30, 1990 | [JP] | Japan | 2-199254 |
| Aug. 1, 1990 | [JP] | Japan | 2-202449 |
| Aug. 8, 1990 | [JP] | Japan | 2-208122 |
| Aug. 27, 1990 | [JP] | Japan | 2-222567 |
| Aug. 30, 1990 | [JP] | Japan | 2-226693 |
| Jun. 18, 1991 | [JP] | Japan | 3-145992 |

[51] Int. Cl.[6] ..... G03G 9/08

[52] U.S. Cl. ..... 430/106.6; 430/110; 430/111; 430/126

[58] Field of Search ..... 430/106.6, 108, 430/109, 110, 111, 138, 126

[56] References Cited

U.S. PATENT DOCUMENTS

| | | | |
|---|---|---|---|
| 2,221,776 | 11/1940 | Carlson | 95/5 |
| 2,297,671 | 9/1942 | Yamasaki | 195/42 |
| 2,618,552 | 11/1952 | Wise | 95/1.9 |
| 2,874,063 | 2/1959 | Greig | 117/17.5 |
| 3,909,258 | 9/1975 | Kotz | 13/8 |
| 4,269,920 | 5/1981 | Wada et al. | 430/107 |
| 4,623,605 | 11/1986 | Kato et al. | 430/110 |
| 4,647,522 | 3/1987 | Lu | 430/110 |
| 4,943,505 | 7/1990 | Aoki et al. | 430/109 |
| 4,957,840 | 9/1990 | Sakashita et al. | 430/106.6 |
| 5,037,717 | 8/1991 | Ishii et al. | 430/110 |
| 5,059,505 | 10/1991 | Kashihara et al. | 430/110 |
| 5,077,169 | 12/1991 | Inoue et al. | 430/110 |
| 5,077,170 | 12/1991 | Tsujihiro | 430/110 |

FOREIGN PATENT DOCUMENTS

| | | |
|---|---|---|
| 52-32256 | 8/1977 | Japan . |
| 54-45135 | 4/1979 | Japan . |
| 56-64352 | 6/1981 | Japan . |
| 60-136755 | 7/1985 | Japan . |
| 61-160760 | 7/1986 | Japan . |
| 62-229158 | 10/1987 | Japan . |
| 63-273601 | 11/1988 | Japan . |
| 63-278910 | 11/1988 | Japan . |
| 64-111 | 1/1989 | Japan . |
| 1-113767 | 5/1989 | Japan . |

OTHER PUBLICATIONS

Translation of JP 2–160251 (1990).

Patent Abstracts of Japan, vol. 14, No. 415 (P–1102) [4358] Sep. 7, 1990 for JPA 2–160251.

*Primary Examiner*—Christopher D. Rodee

*Attorney, Agent, or Firm*—Fitzpatrick, Cella, Harper & Scinto

[57] ABSTRACT

A toner for developing an electrostatic image has colored resin particles-(A) containing a coloring agent or a magnetic powder, and a powdery additive. The powdery additive has organic resin particles-(B) having peaks respectively in a region of particles diameters of 20 mμ to 200 mμ and a region of particle diameters of 300 mμ to 800 mμ in their particle size distribution, and the larger-diameters particles included in the region of particle diameters of 300 mμ to 800 mμ being contained in an amount of from 2% by weight to 20% by weight.

71 Claims, 5 Drawing Sheets

TONER, DEVELOPER AND IMAGE FORMING METHOD

This application is a continuation of application Ser. No. 07/728,264 filed July 11, 1991, now abandoned.

BACKGROUND OF THE INVENTION

1. Field of the Invention

The present invention relates to a toner used for dry electrophotography, for developing an electrostatic image in an image forming process such as electrophotography, electrostatic recording or electrostatic printing. It also relates to a two-component developer and an image forming method.

2. Related Background Art

It is well known to form a latent image on the surface of a photoconductive material through an electrostatic means and develop it.

For example, methods as disclosed in U.S. Pat. No. 2,297,691, Japanese Patent Publications No. 42-23910 and No. 43-24748 and so forth are known in the art. In general, an electrostatic latent image is formed on a photosensitive member, utilizing a photoconductive substance and according to various means, and then the latent image is developed by causing colored resin particles or a toner to adhere onto the latent image to form a toner image. Subsequently, the toner image is transferred to a toner image support material such as paper if necessary, followed by fixing by the action of heat, pressure, heat-and-pressure, or solvent vapor to produce a fixed image. Where the process employs a toner-image transfer step, the process is usually provided with a step of removing the toner remaining on a latent image bearing member.

As developing processes in which an electrostatic latent image is converted to a visible image by the use of a toner, known methods include the powder cloud development as disclosed in U.S. Pat. No. 2,221,776, the cascade development as disclosed in U.S. Pat. No. 2,618,552, the magnetic brush development as disclosed in U.S. Pat. No. 2,874,063, and the method in which a conductive magnetic toner is used, as disclosed in U.S. Pat. No. 3,909,258.

As toners used in these development processes, there is commonly used a fine powder obtained by mixing and dispersing a coloring agent in a thermoplastic resin, melt-kneading the dispersion, cooling the kneaded product, and then finely pulverizing the cooled product. As the thermoplastic resin, polystyrene resins are commonly used, and resins such as polyester resins, epoxy resins, acrylic resins and urethane resins are also used. Carbon black is widely used as a coloring agent of a non-magnetic toner. In the case of a magnetic toner, a black magnetic powder such as magnetic iron oxide is widely used. In the case of the two-component developer, the toner is usually used in admixture with carrier particles such as glass beads, iron powder or ferrite powder.

The toner image formed on a final copied image forming medium such as paper is fixed thereon by the action of heat, pressure or heat-and-pressure. In this fixing step, heat fixing and pressure fixing have been hitherto widely employed.

In recent years, there has been rapid progress in image forming apparatus such as copying machines, as from monochromatic copying to multi-color or full-color copying, where two-color copiers or full-color copiers are being studied and put into practical use.

In methods of forming color images by full-color electrophotography, substantially all colors can be reproduced usually using color toners comprised of a yellow toner, a magenta toner and a cyan toner corresponding to the three primary colors.

In such methods, light reflected from an original is passed through color separation light transmissive filters that are in complementary relations to the colors of toners, to form an electrostatic latent image on a photoconductive layer. Subsequently, developing and transfer steps are taken to adhere toner on a support material. These steps are successively repeated plural times, and toners are superposed with registration on the same support material, followed by fixing in one pass to give a final multi-color image or full-color image.

In the case of a developing system making use of the two-component developer comprised of a toner and a carrier, the toner is electrostatically charged as a result of its friction between it and the carrier, to have the desired electrostatic charges and charge polarity, and thus a latent image is developed by the toner with utilization of static attraction. Accordingly, in order to obtain a good toner image (a visible image), the toner must have a good triboelectric chargeability, which mainly depends on its relation to the carrier.

To resolve this issue, materials that constitute a developer have been studied for the purpose of achieving superior triboelectric chargeability, e.g., investigating carrier cores and carrier coating agents, finding an optimum coating weight, studying charge control agents or fluidity-providing agents added to toners, and improving binder resins for toners.

For example, Japanese Patent Publication No. 52-32256 proposes a technique of adding a charging aid such as electrostatically chargeable fine particles to a toner; Japanese Patent Application Laid-open No. 56-64352, a technique of adding to a developer a fine resin powder having a polarity reverse to that of a toner; and Japanese Patent Application Laid-open No. 61-160760, a technique of adding a fluorine-containing compound to a developer to give a stable triboelectric chargeability.

Another proposal is also seen in an example in which a toner is incorporated with resin particles with a polarity reverse to the triboelectric charge polarity of the toner. For example, Japanese Patent Application Laid-open No. 54-45135 and Japanese Patent Publication No. 52-32256 propose to add colorless resin particles having smaller particle diameters than those of a toner. These publications, however, report that the toner and the reverse-polarity resin particles are different in behavior from each other, where the toner adheres to the latent image portion and the reverse-polarity resin particles adhere to the background portion when development is carried out. This means that the reverse-polarity resin particles promote the electrostatic charging of toners.

Japanese Patent Application Laid-open No. 1-113767 also proposes to use silica and organic resin particles at the same time. The silica and organic resin particles are used for the purpose of weakening the adhesion between a drum and a toner.

Japanese Patent Publication No. 2-3172 (U.S. Pat. No. 4,943,505) proposes a system wherein a toner and organic resin particles are used in mixture so that the electrostatic charging of toners is not deteriorated.

Various means are also proposed as a method in which the additive such as the charging aid as mentioned above and a toner are mixed. For example, it is common to use a method in which the charging aid is caused to adhere to the surface of toner particles by the action of an electrostatic force or the van der Waals' force, where a stirrer or a mixing machine is used as a means therefor. In such a method, however, it is not easy to uniformly disperse the additive to the toner particle surfaces, and is not easy to prevent agglomerates of the additive from being present in a free state in a developer. This tendency becomes more remarkable as the additive such as the charging aid has a larger specific resistance and the additive has a smaller particle diameter. The presence of a large quantity of agglomerates of the additive in a free state in a developer may affect the performance necessary for the developer. For example, the quantity of triboelectricity of the toner may become unstable to cause non-uniform image density, tending to give a foggy toner image.

When copies are continuously taken on a large number of sheets, there is a problem that the content of the charging aid may change to make it difficult to maintain the initial toner image quality.

As another method of addition, there is a method in which the charging aid, etc. is initially added together with a binder resin and a coloring agent when a toner or colored resin particles are prepared. It, however, is not easy to control the quantity of the charging aid, etc. added or the quantity in which it is dispersed to the toner particle surfaces, because it is not easy for the charge control agent to be uniformly dispersed, and also because those agents substantially contributing the chargeability are only those present near the toner particle surfaces and the charging aid or charge control agent present in the interior of a particle does not contribute to the chargeability. When toners are obtained in such a method, the toners tend to have an unstable quantity of triboelectricity. Thus, it is not easy to obtain a developer that can satisfy the development performances stated above.

Moreover, in recent years, there is an increasing demand for achieving a more detailed image and a higher image quality in copiers and printers. In the related technical fields, it has been attempted to achieve a higher image quality by making toner particle diameter smaller. As the toner particle diameter is made smaller, the surface area per unit weight of a toner increases. This tends to increase charges per unit weight of the toner, tending to cause deterioration of durability in the running of a large number of sheets. In addition, because of a large quantity of charges of the toner, toner particles may strongly adhere to one another to bring about a decrease in fluidity, tending to cause problems with stability in toner feeding and in providing triboelectricity to the toner fed.

In the case of color toners with chromatic colors, toner particles have no portions from which charges may leak, since they contain no magnetic material or conductive material such as carbon black. This tends to bring about an increase in charges. This tendency is marked particularly when a polyester type binder having a high charging performance is used in the toners.

The color toners are strongly desired to have the following properties.

(1) In order for color reproduction not to be hindered by a fixed toner because of irregular reflection of light, toner particles are required to be brought into a substantially completely molten state and deformed to such an extent that their original forms can not be recognized.

(2) The color toners must be transparent so that an upper toner layer may not interfere with the color tone of a lower layer having a different color tone.

(3) All color toners must have well balanced hues and spectral reflection characteristics, and sufficient chroma.

Nowadays, polyester resins are widely used as binder resins for color toners. Toners containing polyester resins commonly tend to be affected by temperature and humidity, and tend to cause problems by creating an excess quantity of triboelectricity in a low humidity environment and in developing insufficient quantity of triboelectricity in a high humidity environment. Thus, it has been sought to provide an improved color toners and developers capable of having a stable quantity of triboelectricity.

SUMMARY OF THE INVENTION

An object of the present invention is to provide a toner, and a developer, for developing an electrostatic image, having solved the problems stated above.

Another object of the present invention is to provide a toner, and a developer, for developing an electrostatic image, that are barely influenced by environmental changes in temperature and humidity and have stable triboelectric chargeability.

Still another object of the present invention is to provide a toner, and a developer, for developing an electrostatic image, that can give fog-free, sharp image characteristics and have superior stability when employed with a large number of sheets.

A further object of the present invention is to provide a nonmagnetic color toner that is hardly influenced by environmental changes in temperature and humidity and always has stable triboelectric chargeability.

A still further object of the present invention is to provide a nonmagnetic color toner that can give fog-free, sharp image characteristics and have superior stability during use.

A still further object of the present invention is to provide a non-magnetic black toner, and a developer containing the toner, for developing an electrostatic image, that are hardly influenced by environmental changes in temperature and humidity and have stable triboelectric chargeability.

A still further object of the present invention is to provide a non-magnetic black toner, and a developer containing the toner, for developing an electrostatic image, that can give fog-free, sharp image characteristics and have a superior stability during use.

A still further object of the present invention is to provide a magnetic toner that can attain a stable quantity of triboelectricity between the toner and a toner carrying member such as a sleeve, and can be rapidly controlled to have the charge quantity suited for any developing system used.

A still further object of the present invention is to provide a magnetic toner that can enlarge the difference in density between the dots attributable to faithful development of a digital latent image.

A still further object of the present invention is to provide a magnetic toner that can maintain the initial characteristics even after the toner has been continuously used over a long period of time.

A still further object of the present invention is to provide a magnetic toner that can reproduce stable images free from influences of changes in temperature and humidity.

A still further object of the present invention is to provide a color-image forming method that is hardly influenced by environmental conditions such as temperature and humidity, and has a stable cleaning performance.

A still further object of the present invention is to provide a color-image forming method that can achieve fog-free, sharp image characteristics and also can provide superior stability during use.

The objects of the present invention can be achieved by a toner for developing an electrostatic image, comprising colored resin particles-(A) containing a coloring agent or a magnetic powder, and a powdery additive;

said powdery additive comprising organic resin particles-(B) having peaks respectively in a region of particle diameters of 20 mμ to 200 mμ and a region of particle diameters of 300 mμ to 800 mμ in their particle size distribution, and the larger-diameter particles included in the region of particle diameters of 300 mμ to 800 mμ being contained in an amount of from 2% by weight to 20% by weight.

The objects of the present invention can also be achieved by a developer for developing an electrostatic image, comprising a toner and a carrier;

said toner comprising colored resin particles-(A) containing a coloring agent or a magnetic powder, and a powdery additive;

said powdery additive comprising organic resin particles-(B) having peaks respectively in a region of particle diameters of 20 mμ to 200 mμ and a region of particle diameters of 300 mμ to 800 mμ in their particle size distribution, and the larger-diameter particles included in the region of particle diameters of 300 mμ to 800 mμ being contained in an amount of from 2% by weight to 20% by weight.

The objects of the present invention can also be achieved by an image forming method comprising the steps of;

forming a toner layer on a developer carrying member by means of a coating blade;

forming a developing zone between said developer carrying member and a latent image bearing member opposingly provided thereto;

while applying a bias voltage across said developer carrying member and said latent image bearing member, developing a latent image formed on said latent image bearing member by the use of a toner of the toner layer formed on said developer carrying member, to form a toner image; and transferring said toner image to a transfer medium;

said toner comprising colored resin particles-(A) containing a coloring agent or a magnetic powder, and a powdery additive;

said powdery additive comprising organic resin particles-(B) having peaks respectively in a region of particle diameters of 20 mμ to 200 mμ and a region of particle diameters of 300 mμ to 800 mμ in their particle size distribution, and the larger-diameter particles included in the region of particle diameters of 300 mμ to 800 mμ being contained in an amount of from 2% by weight to 20% by weight.

BRIEF DESCRIPTION OF THE DRAWINGS

In the accompanying drawings.

DESCRIPTION OF THE PREFERRED EMBODIMENTS

Figure 1:
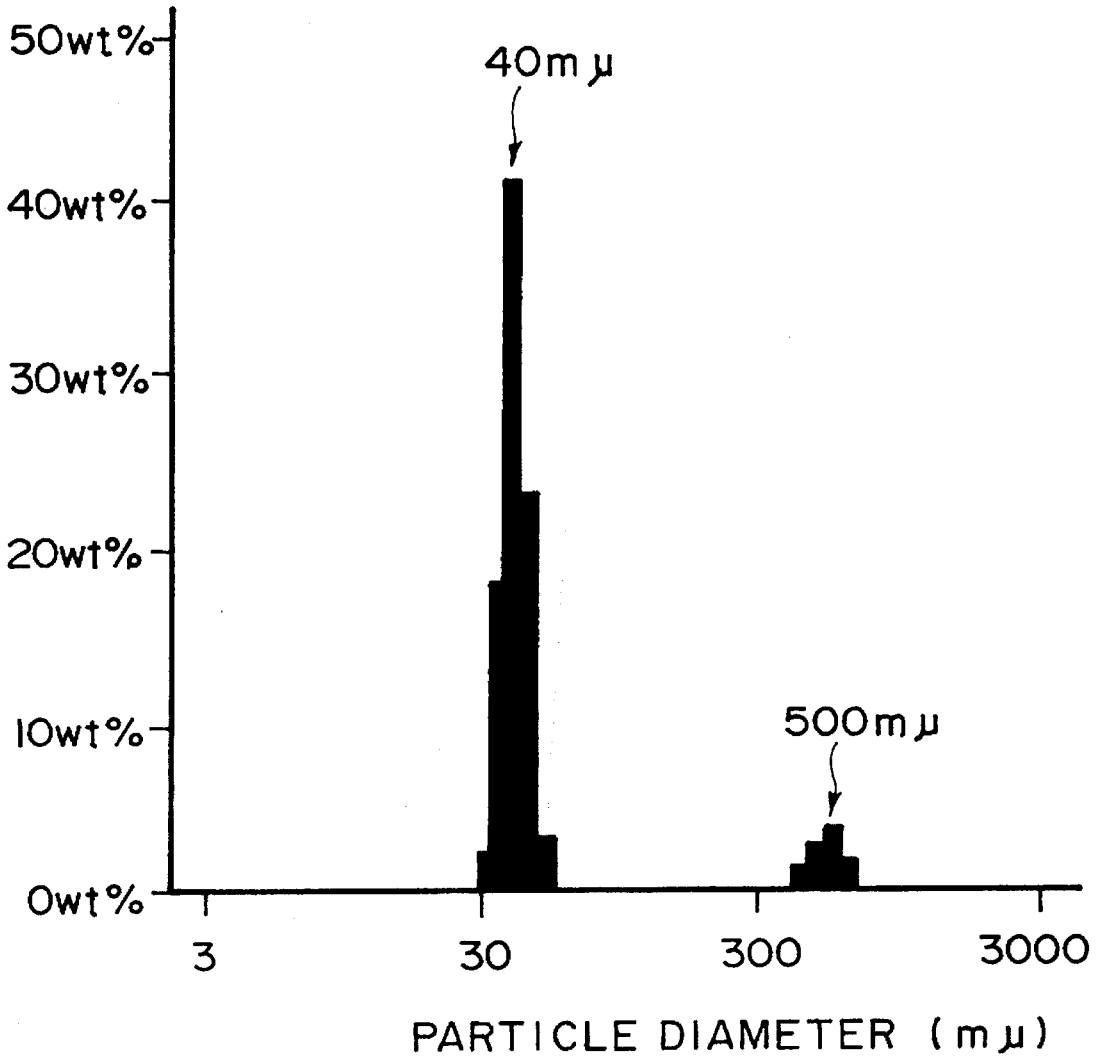
FIG. 1 is a graph which shows an example of the particle size distribution of the organic resin particles used in the present invention.

The present inventors made intensive studies on the environmental stability of the chargeability of toners and developers for developing electrostatic images. As a result, they have discovered that a toner in which organic resin particles having peak values respectively in a region of particle diameters of 20 mμ to 200 mμ and a region of particle diameters of 300 mμ to 800 mμ in their particle size distribution are used as an additive and also the particles included in the region of particle diameters of 300 mμ to 800 mμ (i.e., the particles with larger particle diameter) are contained in an amount of from 2% by weight to 20% by weight, can achieve a very superior stability in the cleaning (in particular, the cleaning by means of a cleaning blade) and chargeability in various environments, and can provide a fog-free, good toner image.

The reason why the chargeability of the toner can be made stable is that the above organic resin particles can prevent the colored resin particles from being charged up because of excessive friction between a carrier and the surface of a developing sleeve.

Moreover, the toner containing such organic resin particles can promote an increase in charges and achieve stable charge characteristics from the initial stage.

The reason therefor can be presumed as follows: The organic resin particles are electrostatically charged in a state such they are more strongly attracted to the carrier side or developing sleeve side rather than the colored resin particles, at the initial stage of the rubbing friction between the carrier or developing sleeve and the toner. Hence, an increase in charges of the colored resin particles can be promoted. On the other hand, after the colored resin particles have gained a given quantity of charges, the organic resin particles are more strongly attracted to the colored resin particles rather than to the carrier or developing sleeve, where they have a function of restraining excessive charging. The toner of the present invention can therefore increase the charges, and maintain the level of saturated charges (the level of given charges) in a good and stable state in various environments.

In addition, the cleaning performance of the toner can be made stable. The reason therefor is as follows: The organic resin particles reduce the triboelectricity of the toner in a low humidity environment, so that the toner transfer efficiency is improved and the quantity of the toner remaining on the photosensitive member decreases. Moreover, the resin particles with particle diameter of 300 mμ to 800 mμ are relatively large in particle diameter for the powdery additive, which remains on the photosensitive member at the time of static transfer, and hence have the function of effectively removing paper dust or the like present on the photosensitive member.

In order to make the above functions more effective, the organic resin particles have peaks in a region of particle diameters of 20 mμ to 200 mμ, and preferably 30 mμ to 150 mμ, and a region of particle diameters of 300 mμ to 800 mμ, and preferably 400 mμ to 700 mμ, in their particle size distribution, and the larger-diameter particles included in the region of particle diameters of 300 mμ to 800 mμ are contained in an amount of from 2% by weight to 20% by weight, and preferably 3% by weight to 13% by weight.

In a more preferred embodiment, the organic resin particles should have a volume resistivity of $10^6\Omega\cdot$cm to $10^{16}\Omega\cdot$cm.

A volume resistivity larger than $10^{16}\Omega\cdot$cm tends to result in an increase in agglomerating properties of the organic resin particles, tending to bring about a lowering of blending properties when mixed with the colored resin particles. It may also result in charge-up of the organic resin particles themselves, where the toner may float about on non-image areas together with the organic resin particles to cause fog, or difficulties tend to occur such that, because of excessively strong adhesion to the latent image bearing member, the toner undergoes fusion or is adhered to the developer carrying member.

A volume resistivity smaller than $10^6\Omega\cdot$cm tends to bring about a decrease in the toner charges in an environment of high temperature and high humidity, resulting in faulty toner images because of occurrence of fog or toner scatter and occurrence of a leak phenomenon at the time of development.

The organic resin particles may preferably have a polarity reverse to the polarity of the colored resin particles. Stated specifically, in the case when the colored resin particles are triboelectrically negatively charged as a result of the friction between them and the carrier particles or developing sleeve, the organic resin particles may preferably be triboelectrically positively charged as a result of the friction between them and the carrier particles or developing sleeve.

In the present invention, in order for the toner to definitely achieve the cleaning performance and to have a stable triboelectric chargeability, the reverse-polarity organic resin particles may preferably be mixed in an amount of 0.1 part by weight to 5.0 parts by weight based on 100 parts by weight of the colored resin particles.

The organic resin particles are preferable also when the colored resin particles or toner particles are made smaller, e.g., made to have a weight average particle diameter of 5 μm to 9 μm.

Making the colored resin particles or toner particles smaller may result in an increase in contact points between them and the carrier or the developer carrying member, tending to cause toner adhesion, or may result in an increase in contact points between toner particles, tending to cause toner blocking. On the other hand, the organic resin particles having the suitable size as described above can act as good spacers to bring about good results. It is much more effective against toner blocking to use as a material for the reverse-polarity organic resin particles a material having a higher glass transition point (Tg) than a binder resin for the colored resin particles.

In the present invention, using the reverse-polarity organic resin particles with sufficiently smaller particle diameters than the particle diameters of the colored resin particles, they are finally brought into strong adhesion to the colored resin particles so that they can act together to develop the latent image, and reverse-polarity organic resin particles on the relatively coarse side are made to appropriately remain in a transfer residue present on the surface of the latent image bearing member after transfer. Thus, the cleaning performance can be improved.

In contrast with the prior art, the reverse-polarity organic resin particles are used in the non-magnetic color toner tending to be charged up, whereby the chargeability is intentionally lowered in the present invention.

Organic resin particles with particle diameters smaller than 20 mμ tend to be excessively strongly adhered to, or be embedded in, the colored resin particles and tend to make less effective the addition of the organic resin particles. The organic resin particles with particle diameters of 20 mμ to 200 mμ can be superior in dispersibility and can be uniformly adhered onto the colored resin particles, so that the toner can achieve a good triboelectric chargeability. Organic resin particles with particle diameters larger than 800 mμ tend to cause undesired effects such that they tend to be non-uniformly dispersed, tend to promote separation of the organic resin particles, tend to bring about a lowering of the cleaning effect, and tend to make poor the triboelectric charge characteristics of the toner.

FIG. 1 shows a particle size distribution of organic resin particles used in Example 1 described later. As is seen from FIG. 1, the organic resin particles have peaks respectively at a particle diameter of 40 mμ and a particle diameter of 500 mμ.

In the present invention, it is preferred in view of function separation to use the organic resin particles having the particle size distribution in which the region of particle diameters of 20 mμ to 200 mμ and region of particle diameters of 300 mμ to 800 mμ are clearly divided as shown in FIG. 1.

There are no particular limitations on monomers which constitute the organic resin particles, but the monomers must be selected taking into account the charges of the toner. Addition-polymerizable monomers can be used in the present invention. As examples thereof, they may include the following vinyl type monomers.

They may include styrene, and derivatives thereof as exemplified by alkyl styrenes such as methyl styrene, dimethyl styrene, trimethyl styrene, ethyl styrene, diethyl styrene, triethyl styrene, propyl styrene, butyl styrene, hexyl styrene, heptyl styrene and octyl styrene; halogenated styrenes such as fluorostyrene, chlorostyrene, bromostyrene, dibromostyrene and iodostyrene; nitrostyrene, acetylstyrene, and methoxystyrene.

The monomers may also include addition-polymerizable unsaturated carboxylic acids. They can be exemplified by addition-polymerizable unsaturated aliphatic monocarboxylic acids such as acrylic acid, methacrylic acid, α-ethylacrylic acid, crotonic acid, α-methylcrotonic acid, α-ethylcrotonic acid, isocrotonic acid, tiglic acid and ungelic acid; and addition-polymerizable unsaturated aliphatic dicarboxylic acids such as maleic acid, fumaric acid, itaconic acid, citraconic acid, mesaconic acid, glutaconic acid and dihydromuconic acid.

It is also possible to use those obtained by forming these carboxylic acids into metal salts. They can be formed into metal salts after completion of polymerization.

Esterified compounds of the above addition-polymerizable unsaturated carboxylic acids with an alcohol such as an alkyl alcohol, a halogenated alkyl alcohol, an alkoxyalkyl alcohol, an aralkyl alcohol or an alkenyl alcohol may also be included.

The above alcohol can be exemplified by alkyl alcohols such as methyl alcohol, ethyl alcohol, propyl alcohol, butyl alcohol, amyl alcohol, hexyl alcohol, heptyl alcohol, octyl alcohol, nonyl alcohol, dodecyl alcohol, tetradecyl alcohol and hexadecyl alcohol; halogenated alcohols obtained by halogenating part of any of these alkyl alcohols; alkoxyalkyl alcohols such as methoxyethyl alcohol, ethoxyethyl alcohol, ethoxyethoxyethyl alcohol, methoxypropyl alcohol and ethoxypropyl alcohol; aralkyl alcohols such as benzyl alcohol, phenylethyl alcohol and phenylpropyl alcohol; and alkenyl alcohols such as allyl alcohol and crotonyl alcohol.

The monomers may also include amides and nitriles derived from any of the above addition-polymerizable unsaturated carboxylic acids; aliphatic monoolefins such as ethylene, propylene, butene and isobutene; halogenated aliphatic olefins such as vinyl chloride, vinyl bromide, vinyl iodide, 1,2-dichloroethylene, 1,2-dibromoethylene, 1,2-diiodoethylene, isopropenyl chloride, isopropenyl bromide, allyl chloride, allyl bromide, vinylidene chloride, vinyl fluoride and vinylidene fluoride; and conjugated diene type aliphatic diolefins such as 1,3-butadiene, 1,3-pentadiene, 2-methyl-1,3-butadiene, 2,3-dimethyl-1,3-butadiene, 2,4-hexadiene and 3-methyl-2,4-hexadiene.

They may further include nitrogen-containing vinyl compounds such as vinyl acetates, vinyl ethers, vinyl carbazole, vinyl pyridine and vinyl pyrrolidone.

In the present invention, those obtained by polymerizing any one or more kinds of these monomers can be used in the organic resin particles.

The organic resin particles used in the present invention can be produced by any method by which fine particles can be produced, such as spray drying, suspension polymerization, emulsion polymerization, soap-free polymerization, seed polymerization and mechanical pulverization. Of these, soap-free polymerization is particularly suitable, since it does not inhibit the chargeability of the toner and may give less environmental variations of volume resistivity since it produces no residual emulsifying agent at all.

In order to prepare the organic resin particles having peaks respectively in the region of particle diameters of 20 mμ to 200 mμ and the region of particle diameters of 300 mμ to 800 mμ in their particle size distribution, two kinds of resin particles may be dry-blended, or may be wet-blended and then dried. They may preferably be prepared by combining primary particles of an organic resin when a polymer is dried from the state of an emulsion after polymerization to prepare the organic resin particles having the two peaks in their particle size distribution. If necessary, the resulting organic resin particles may further be heated or disintegrated.

The organic resin particles may optionally be subjected to a surface treatment. The surface treatment may be carried out by a method in which the surfaces of resin particle are treated by vacuum deposition or coating, using a metal such as iron, nickel, cobalt, copper, zinc, gold or silver; a method in which the above metal, a magnetic material or a metal oxide such as conductive zinc oxide is fixed onto the surfaces of resin particle by ion adsorption or external addition; or a method in which an organic compound capable of being triboelectrically charged, such as a pigment or dye or a polymer resin is supported on the surfaces of resin particles by coating or external addition.

The organic resin particles used in the present invention may preferably have a peak molecular weight in the range of from 10,000 to 5,000,000, and more preferably in the range of from 20,000 to 1,000,000, in the molecular weight distribution measured by gel permeation chromatography. Organic resin particles with a peak molecular weight larger than 5,000,000 tend to adversely affect the fixing performance of the color toner, and those with a peak molecular weight smaller than 10,000 tend to cause contamination or make blocking resistance poor.

In the present invention, the organic resin particles described above may be used in combination with a fluidity improver. The fluidity improver may particularly preferably be an inorganic oxide or a hydrophobic inorganic oxide. The hydrophobic inorganic oxide compensates for the resin particles from the viewpoint of its ability to impart chargeability and fluidity.

In the present invention, the inorganic oxide may include titanium oxide and aluminum oxide, in combination with which the organic resin particles described above may preferably be used. The titanium oxide or aluminum oxide shows substantially constant charge characteristics without influence of temperature and humidity when brought into triboelectric charging with a carrier. Hence, it can impart fluidity without damaging the stability in the charging of toners, so that development performance and transfer performance can be well improved.

Japanese Patent Application Laid-open No. 60-136755 or No. 62-229158 disclose an example in which titanium oxide is added to a developer. This example, however, is concerned with the use of titanium oxide in combination with silica, and is different from the present invention concerned with a combination of the organic resin particles and titanium oxide.

The titanium oxide or aluminum oxide may have been subjected to a surface treatment so long as the stability of charging is not damaged.

The titanium oxide or aluminum oxide, i.e., fine titanium oxide powder or fine aluminum oxide powder, should have a BET specific surface area ranging from 30 $m^2/g$ (average particle diameter: about 40 mμ) to 200 $m^2/g$ (average particle diameter: about 12 mμ).

For example, titanium oxide or aluminum oxide with a BET specific surface area larger than 200 $m^2/g$ can achieve a sufficient fluidity, but on the other hand may give a toner liable to deterioration because of its hydrophilic nature. The deterioration occurs as a phenomenon such that the charges greatly change or the fluidity of toner becomes poor when copies are continuously taken for a long time in the state of a small toner consumption.

Titanium oxide or aluminum oxide with a BET specific surface area smaller than 30 $m^2/g$ tends to bring about an insufficient fluidity, and also tends to cause fog in toner images.

The fine titanium oxide powder or fine aluminum oxide powder may be added preferably in an amount of 0.3% by weight to 2% by weight, which correlates with the particle size distribution of the organic resin particles. Its addition in an amount less than 0.3% by weight makes it difficult to achieve an appropriate fluidity. Its addition in an amount more than 2% by weight tends to cause ill effects such as toner scatter and fog.

As the hydrophobic inorganic oxide, it is preferred to use a treated fine silica powder obtained by subjecting to hydrophobic treatment a fine silica powder produced by gaseous phase oxidation of a silicon halide. The treated fine silica powder may preferably have a BET specific surface area of not less than 80 $m^2/g$, and more preferably not less than 150 $m^2/g$.

For the treated fine silica powder, it is particularly preferred to use a fine silica powder so treated that the degree of hydrophobicity as measured by methanol titration is in a value ranging from 30 to 80.

The fine silica powder can be made hydrophobic by chemical treatment with a hydrophobicizer such as an organic silicon compound capable of reacting with, or being physically adsorbed on, the fine silica powder.

As a preferred method, a fine silica powder produced by vapor phase oxidation of a silicon halide is treated with an organic silicon compound.

Such an organic silicon compound may include hexamethyldisilazane, trimethylsilane, timethylchlorosilane, timethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in the units positioned at the terminals. These may be used alone or in the form of a mixture of two or more kinds.

Commercially available products may include Tullanox-500 (Tulco Co.) and AEROSIL R-972 (Aerosil Japan Ltd.). This compound may be added preferably in an amount of 0.3% by weight to 2% by weight based on the colored resin particles.

The amount for its addition also correlates with the particle size distribution of the organic resin particles. Its addition in an amount less than 0.3% by weight makes it difficult to achieve an appropriate fluidity. Its addition in an amount more than 2% by weight tends to cause ill effects such as toner scatter and fog.

The colored resin particles according to the present invention may be incorporated with a charge control agent so that the charge characteristics can be stabilized. In that instance, it is preferred to use a colorless or pale-color charge control agent that does not affect the color tone of the colored resin particles. A negative charge control agent may include organic metal complexes as exemplified by a metal complex of an alkyl-substituted salicylic acid, e.g., a chromium complex or zinc complex of di-tert-butylsalicylic acid. When the negative charge control agent is incorporated with the colored resin particles, it should be added in an amount of 0.1 part by weight to 10 parts by weight, and preferably in an amount of 0.5 part by weight to 8 parts by weight, based on 100 parts by weight of a binder resin for the colored resin particles.

As the coloring agent used in the present invention, known dyes or pigments can be used. For example, it is possible to use Phthalocyanine Blue, Indanthrene Blue, Peacock Blue, Permanent Red, Lake Red, Rhodamine Lake, Hansa Yellow, Permanent Yellow and Benzidine Yellow. The coloring agent may be contained in an amount of not more than 12 parts by weight, and preferably 0.5 part by weight to 9 parts by weight, based on 100 parts by weight of the binder resin so that it can be sensitive to the transmission of OHP films.

In the case when carbon black is used as the coloring agent in the present invention, the carbon black may preferably have an average primary particle diameter of 50 mμ to 70 mμ, and more preferably 60 mμ to 70 mμ, a surface area of 10 $m^2/g$ to 40 $m^2/g$, and more preferably 30 $m^2/g$ to 40 $m^2/g$, an oil absorption of 50 cc/100 g-DBP to 100 cc/100 g-DB, and more preferably 60 cc/100 g-DBPP to 70 cc/100 g-DBP, and a pH value of 6.0 to 9.0.

The above ranges correlate with the resistance and amount of the organic resin particles serving as an additive. Use of carbon black with an average particle diameter of smaller than 50 mμ tends to bring about a decrease in the quantity of triboelectricity resulting from the friction between the colored resin particles and carrier particles to cause toner scatter or fog. Use of carbon black with a surface area larger than 40 $m^2/g$ tends to cause a phenomenon of the scattering of toner at edge portions of visible images obtained (i.e., black spots around images). In regard to the oil absorption, carbon black particles may be agglomerated during the fixing of images if it is more than 100 cc/100 g-DBP, and a sufficient image density can not be obtained with ease if it is less than 50 cc/100 g-DBP. If the pH is less than 6.0, the carbon black tends to be non-uniformly dispersed in the binder resin, tending to result in an unstable chargeability.

In the measurement of the above physical properties of the carbon black, the particle diameter is measured by directly separatingly ascertaining the size of particles by scanning electron microscope photography. Methods of measuring the surface area, oil absorption and pH value will be described below. The surface area is measured according to the BET method as prescribed in ASTM D3037-78.

Figure 5:
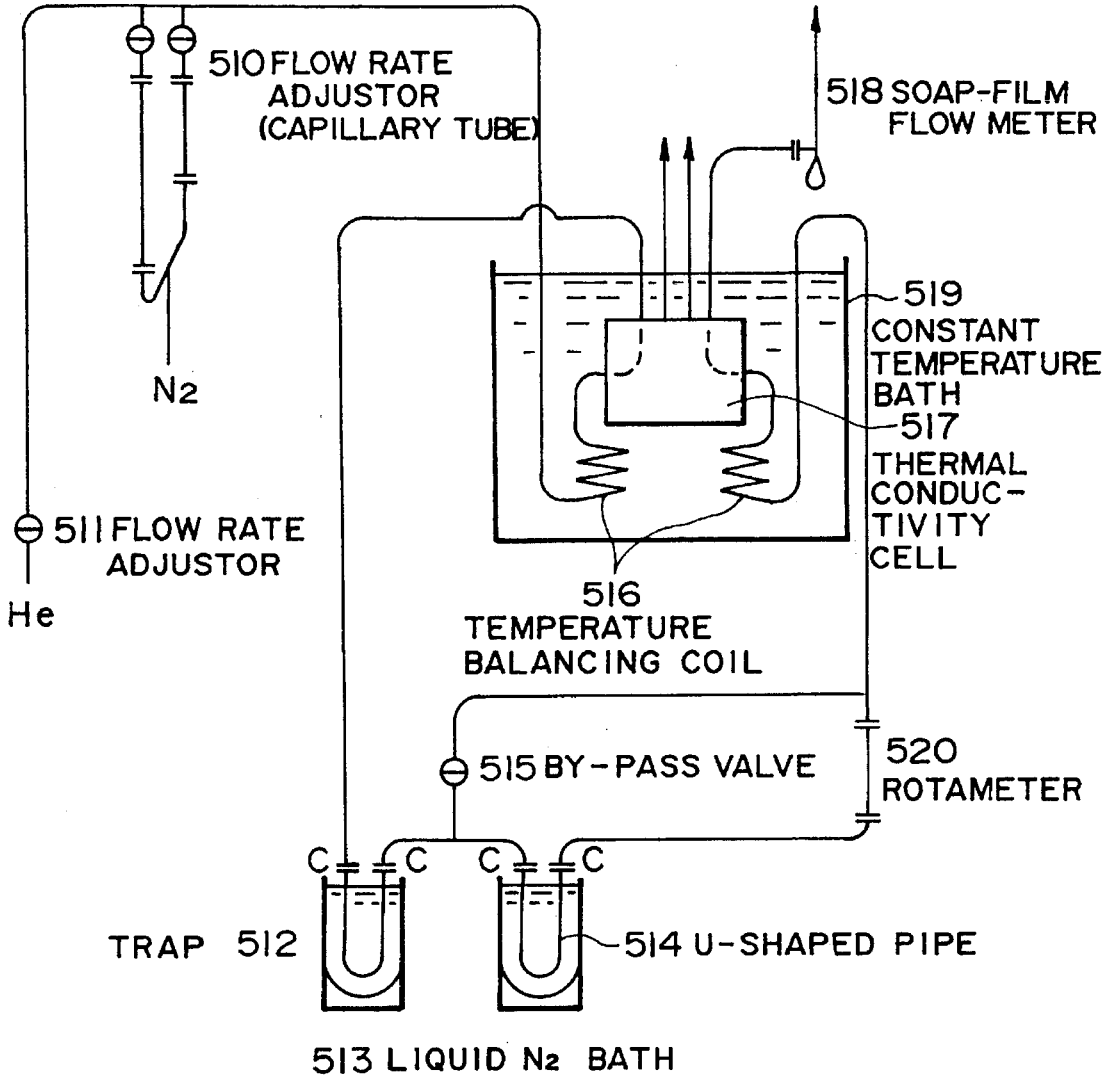
FIG. 5 is a schematic illustration of an apparatus system for measuring the specific surface area of carbon black.

Following the flow chart as shown in FIG. 5, a mixed gas of $N_2$ and He is flowed to carbon black to effect adsorption of $N_2$ thereon, and an adsorption of $N_2$ is detected through a thermal conductivity cell 517. Calculation is made on the basis of the $N_2$ adsorption to determine the specific surface area.

1) A sample is dried at 105° C. for 1 hour. Thereafter the dried sample is precisely weighed in a quantity of 0.1 to 1 g, and put in a U-shaped pipe 514, which is then fitted to the flow path.

2) The $N_2$/He mixing ratio is changed by means of flow rate adjustors 510 (a capillary tube) and 511 and set to a given ratio of $P/P_0$.

The numeral 515 denotes a by-pass valve; 516, temperature balancing coils; 518, a soap-film flow meter; 519, a constant temperature bath; and 520, a rotameter.

3) A cock is opened to introduce absorbed gases to a sample layer and thereafter the U-shaped pipe is immersed in liquid $N_2$ 513 to effect adsorption of $N_2$.

4) After the adsorption has reached equilibrium, the liquid $N_2$ is removed, and the sample is exposed to the air for 30 sec. The U-shaped pipe is then immersed in water kept at room temperature to effect desorption of $N_2$.

5) The desorption curve is drawn on a recorder to measure the area.

6) Using a calibration curve prepared by introducing a known quantity of $N_2$ prior to these operations, the $N_2$ adsorption at a given $P/P_0$ is determined from the area obtained on the above sample.

The surface area is determined according to the following expression:

$$\frac{P}{v(P_0-P)}=\frac{1}{v_m C}+\frac{C-1}{v_m C}\times\frac{P}{P_0}$$

wherein:

$P_0$: Saturated vapor pressure of adsorbate at a measured temperature

P: Pressure at the adsorption equilibrium v: Adsorption at the adsorption equilibrium C: Constant The relation between $P/P_0$ and $P/v(P_0-P)$ forms a straight line, and $v_m$ is determined from its gradient and section. After determination of $v_m$, the specific surface area can be calculated according to the following expression:

$$S=A\times v_m\times N/W$$

wherein:

S: Specific surface area

A: Sectional areas of adsorbed molecules

N: Avogadro's number

W: Quantity of the sample

Oil Absorption (DBP Method)

The oil absorption is measured according to ASTM D2414-79. A cock of an absorptometer is operated to fill an automatic burette system with DBP (dibutyl phthalate), which is completely so filled that no air bubble may be left in the system. The apparatus is set to operate under the following conditions.

(1) Spring tension: 2.68 kg/cm (2) Rotor revolution number: 125 rpm (3) Graduation of torque limit switch: 5

(4) Damper valve: 0.150

(5) Rate of dropwise addition of DBP: 4 ml/min

The rate of dropwise addition of DBP is controlled on the basis of actual measurements, and then a given quantity of dried sample is put in an mixing chamber of the absorptometer. The counter of the burette is set to the point "zero", and its switch is set automatic to start dropwise addition of DBP. When the torque have reached the set point (in this case, 5), the limit switch is operated to automatically stop the dropwise addition. Graduation (V) of the burette counter at that time is read, and the oil absorption is calculated according to the following expression:

$$OA=V/W\times 100$$

wherein:

OA: Oil absorption (ml/100 g)

V: The amount (ml) in which DBP is used until it reaches the end point (the point at which the limit switch is operated)

W: Weight (g) of dried sample pH Value

Carbon black is weighed in a beaker in a quantity of 1 to 10 g, and water is added at a rate of 10 ml per 1 g of the sample. The beaker is covered with a watch glass, and its content is boiled for 15 minutes. In order to make the sample readily wettable, ethyl alcohol may be added several drops. After boiling, the sample is cooled to room temperature and the surpernatant liquid is removed by decantation or centrifugal separation to leave a pasty product. In this pasty product, an electrode of a glass electrode pH meter is inserted to measure the pH according to JIS Z8802 (a pH measuring method). In this instance, the measurements may become different depending on the position at which the electrode is inserted. Accordingly, the beaker is moved so that the position of the electrode is changed, and the measurement is made with care so taken as to bring the electrode surface and the pasty product surface into sufficient contact, and the value is read at the point where the pH value has become constant.

In the present invention, the specific carbon black as described above should be used in an amount of 2.0% by weight to 10% by weight, and preferably 3.0% by weight to 7% by weight, based on the total weight of the colored resin particles. The carbon black added in an amount less than 2.0% by weight tends to cause coarse images or a down of image density, in the visible images obtained. On the other hand, the carbon black contained in an amount more than 10% by weight tends cause black spots around images and fog.

The binder resin used in the colored resin particles may be any of the various material resins conventionally known as toner binder resins for electrophotography.

They can be exemplified by styrene homopolymers or copolymers such as polystyrene, a styrene/butadiene copolymer and a styrene/acrylate copolymer, ethylene homopolymers or copolymers such as polyethylene, an ethylene/vinyl acetate copolymer and an ethylene/vinyl alcohol copolymer, phenol resins, epoxy resins, acrylphthalate resins; polyamide resins, polyester resins, and maleic acid resins.

Of these resins, the effect of the present invention can be greatest particularly when polyester resins are used, which have a high negative chargeability. The polyester resins can achieve excellent fixing performance, and are suited for color toners. Although the polyester resins on the other hand have a strong negative chargeability and tend to give an excess quantity of triboelectricity, the problems involved in the polyester resins are settled and a superior toner can be obtained, when the polyester resins are used as the binder resin for the colored resin particles contained in the toner of the present invention.

In particular, in view of sharp melt properties, a more preferred resin is a polyester resin obtained through copolycondensation of i) a diol component comprising a bisphenol derivative represented by the formula:

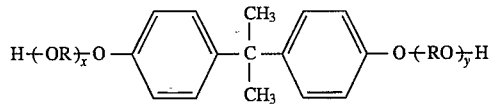

wherein R represents an ethylene group or a propylene group, and x and y each represent an integer of 1 or more, where x+y is 2 to 10 on the average and ii) a carboxylic acid component comprising a dibasic or more basic carboxylic acid, its acid anhydride or its lower alkyl ester, as exemplified by fumaric acid, maleic acid, maleic anhydride, phthalic acid, terephthalic acid, trimellitic acid and pyromellitic acid.

As the binder resin for the colored resin particles, it is preferred in view of the improvement in heat-fixing performance and blocking resistance of the toner to use an (AB)n-type block copolymer.

The polymer of unit A or unit B that constitutes the $(AB)_n$-type block copolymer used in the present invention can be synthesized from the following styrene monomers and acrylic monomers, and vinyl monomers containing a carboxyl group.

The styrene monomers can be exemplified by styrene, and styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxylstyrene, p-chlorostyrene, 3,4-dichlorostyrene, m-nitrostyrene, o-nitrostyrene and p-nitrostyrene.

The acrylic monomers can be exemplified by acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate.

The compositional ratio of the monomers in the unit-A polymer should be in the range of styrene monomers/acrylic monomers=98/2 to 65/35, and preferably 95/5 to 70/30. The compositional ratio of the monomers in the unit-B polymer should be in the range of styrene monomers/acrylic monomers=95/5 to 40/60, and preferably 85/15 to 50/50. Other monomers may also be copolymerized so long as the present invention is not adversely affected.

The vinyl monomers containing a carboxyl group may include acrylic acid, methacrylic acid, crotonic acid, itaconic acid, cinnamic acid, maleic anhydride, fumaric acid, maleic acid, and monoesters thereof such as methyl, ethyl, butyl or 2-ethylhexyl esters thereof. These are used alone or in combination. Such monomers may be copolymerized to the $(AB)_n$-type block copolymer in an amount of 0.1% by weight to 30% by weight, and preferably 0.5% by weight to 20% by weight.

The vinyl monomers containing a carboxyl group may be copolymerized to any one of the unit A and the unit B, or may be copolymerized to both of the unit A and the unit B.

In the case when the vinyl monomers containing a carboxyl group are copolymerized to both the unit A and the unit B, they may be in the same amount or in different amounts.

The $(AB)_n$-type block copolymer may be used in the form of a mixture with other polymers or copolymers so long as its properties are not compromised.

The $(AB)_n$-type block copolymer can be synthesized by the methods disclosed in Japanese Patent Applications Laid-open No. 63-278910, No. 63-273601 and No. 64-111, in which radical polymerizable vinyl monomers are subjected to bulk polymerization or solution polymerization under exposure to light using a polymerization initiator having a dithiocarbamate group.

In the toner of the present invention, additives may be optionally mixed so long as the properties of the toner are not damaged. Such additives can be exemplified by a lubricant such as Teflon, zinc stearate or polyvinylidene fluoride, and a fixing aid as exemplified by a low-molecular weight polyethylene or a low-molecular weight polypropylene.

In the manufacture of the toner of the present invention, it is possible to apply a method in which component materials are well kneaded by means of a heat kneading machine such as a heat roll, a kneader or an extruder and thereafter the kneaded product is mechanically pulverized and classified to obtain a toner; a method in which a material such as a coloring agent is dispersed in a solution of a binder resin and thereafter the dispersion is spray-dried to give a toner; and a method of producing a polymerization toner, in which given materials are mixed in the monomers that constitute a binder resin and thereafter the resulting emulsion or suspension is polymerized to give a toner.

In the case of the color toner, its effect can be more remarkable when non-magnetic colored resin particles have a weight average particle diameter of 6 μm to 10 μm; non-magnetic colored resin particles with particle diameters not larger than 5 μm are contained in an amount of 15 to 40% by number, those with particle diameters of 12.7 μm to 16.0 μm in an amount of 0.1 to 5.0% by weight, and those with particle diameters not smaller than 16 μm in an amount of not more than 1.0% by weight; and non-magnetic colored resin particles with particle diameters of 6.35 μm to 10.1 μm have a particle size distribution satisfying the following expression:

$$9 \leqq \frac{V \times \bar{d}4}{N} \leqq 14$$

wherein V represents % by weight of the non-magnetic colored resin particles with particle diameters of 6.35 μm to 10.1 μm; N represents % by number of the non-magnetic colored resin particles with particle diameters of 6.35 μm to 10.1 μm; and $\bar{d}4$ represents a weight average diameter of the non-magnetic colored resin particles.

The non-magnetic color toner comprising the non-magnetic colored resin particles having the above particle size distribution enables reproduction faithfully to a latent image formed on a photosensitive member, and also has a superior performance of reproducing fine dot latent images such as halftone images or digital images. In particular, it can give images with superior gradation and resolution at highlight portions. Moreover, it can maintain a high image quality even when copying or printing is continued. Even in the case of an image with a high density, it enables good development at a smaller toner consumption than conventional non-magnetic toners, having an economical advantage and also being advantageous in providing small-sized copiers or printers.

The reason why such effect can be obtained in the non-magnetic color toner of the present invention is not necessarily clear, but can be presumed as follows:

It has been hitherto considered that, in non-magnetic color toners, colored resin particles with particle diameters not larger than 5 μm must be positively decreased as a component that may make it difficult to control charges and may cause toner scatter to contaminate machine parts and also as a component that may cause fog of images.

Studies made by the present inventors, however, have revealed that the colored resin particles with particle diameters of about 5 μm are essential as a component for forming a high-quality image.

For example, using a two-component developer having a non-magnetic toner comprising colored resin particles with a particle size distribution over the range of from 5 μm to 30 μm and a carrier, latent images with varied latent image potentials on a photosensitive member were developed while changing the surface potential on the photosensitive member. The latent images were so made as to vary from an image with so large a development potential contrast that a large number of colored resin particles are used for the development, to a half-tone image, and also to an image with minute dots which are so small that only a small quantity of colored resin particles are used for the development. After the development, the colored resin particles used for each development were collected and their particle size distribution was measured. As a result, it was revealed that colored resin particles with particle diameters not larger than about 8 μm were present in a large number, in particular, colored resin particles with particle diameters of about 5 μm were present in a large number on the latent image comprised of minute dots. Thus, images with really superior reproducibility that are faithful to latent images without misregistration from the latent images can be obtained when the colored resin particles with particle diameters of about 5 μm are smoothly used or supplied for the development of latent images.

As a matter correlating with the necessity for the presence of the colored resin particles with particle diameters of about 5 μm, it is true that colored resin particles with particle diameters not larger than 5 μm are capable of faithfully reproducing a latent image comprised of minute dots, but they have considerably high agglomerating properties in themselves and hence tend to damage the fluidity required for toners.

The present inventors, aiming at an improvement of the fluidity, have attempted to add a fluidity improver so that the fluidity can be improved. It, however, was found difficult to satisfy the items of image density, toner scatter, fog, etc. Now, the present inventors further studied the particle size distribution of colored resin particles and have discovered that the fluidity can be more improved and a high image quality can be achieved, when colored resin particles with particle diameters not larger than 5 μm are incorporated in an amount of 15 to 40% by number and also colored resin particles with particle diameters of 12.7 μm to 16.0 μm are incorporated in an amount of 0.1 to 5.0% by weight. This is presumably because the colored resin particles with particle diameters ranging from 12.7 μm to 16.0 μm have an appropriately controlled fluidity to the colored resin particles with particle diameters not larger than 5 μm, so that sharp images with a high density and superior resolution and gradation can be provided even when copying or printing is continued.

During studies on the state of particle size distribution and the development performance, the present inventors have also discovered, with regard to colored resin particles with particle diameters of 6.35 μm to 10.1 μm, the presence of the particle size distribution most suited for achieving the objects, as shown by the above expression.

When the particle size distribution is controlled by the commonly available air classification, it can be understood that an instance in which the value of the above expression is large shows an increase in the colored resin particles with particle diameters of about 5 μm that are attributable to the faithful reproduction of minute-dot images, and an instance in which the value is small shows on the other hand a decrease in the colored resin particles with particle diameters of about 5 μm.

Thus, a much better fluidity of the toner and a more faithful latent image reproducibility can be achieved when the weight average particle diameter ($\bar{d}4$) is in the range of 6 μm to 10 μm and also the above relationship is further satisfied.

Colored resin particles with particle diameters larger than 16 μm should be controlled to be in an amount of not more than 1.0% by weight, which is preferred to be as little as possible.

The colored resin particles with particle diameters not larger than 5 μm should be contained in an amount of 15 to 40% by number, and preferably 20 to 35% by number, of the total particle number. If the colored resin particles with particle diameters not larger than 5 μm are less than 15% by number, colored resin particles effective for high image quality may become short, in particular, effective colored resin particle components may decrease as the toner is used upon continuance of copying or printing, so that there is a possibility of losing the balance of particle size distribution of colored resin particles, defined in the present invention, to cause a gradual lowering of image quality. If they are more than 40% by number, the colored resin particles tend to agglomerate with one another and tend to form a mass of colored resin particles with larger particle diameters than the original ones, resulting in a coarse-image quality, a lowering of resolution, or an increase in the density difference between edges and inner areas of latent images, which tends to give images with little blank areas.

The colored resin particles with particle diameter with particle diameters ranging from 12.7 μm to 16.0 μm should be in an amount of 0.1% by weight to 5.0% by weight, and preferably 0.2% by weight to 3.0% by weight. If they are in an amount more than 5.0% by weight, image quality may become poor and also excessive development (i.e., overfeeding of toner) may occur, causing an increase in toner consumption. On the other hand, if they are in an amount less than 0.1% by weight, there is a possibility of a decrease in image density because of a lowering of fluidity.

The colored resin particles with particle diameters not smaller than 16 μm should be contained in an amount of not more than 1.0% by weight, and more preferably not more than 0.6% by weight. If they are in an amount more than 1.0% by weight, not only fine-line reproduction may be hindered, but also, in the step of transfer, the state of a delicate close contact between a photosensitive member and a transfer sheet through a toner layer may become irregular to tend to cause variations in transfer conditions, because little coarse colored resin particles with particle diameters not smaller than 16 μm may protrude present at the surface of a thin layer comprising the colored resin particles used for development, formed on the photosensitive member.

The non-magnetic color toner should have a weight average particle diameter of 6 μm to 10 μm, and preferably 7 μm to 9 μm. This value must be taken into account together with the respective component factors previously described. A non-magnetic color toner with a weight average particle diameter smaller than 6 μm may give an insufficient toner transfer weight on the transfer sheet, tending to cause the problem of a low image density. This is presumed to be caused by the same reason for the problem that the density decreases at inner areas of latent images with respect to edges thereof. A non-magnetic color toner with a weight average particle diameter larger than 10 μm may give no good resolution, tending to cause a lowering of image quality after continuous copying even though the image quality is good at the initial stage.

The particle size distribution of the colored resin particles or the toner can be measured by various methods. In the present invention, it was measured using a Coulter counter.

A Coulter counter Type TA-II (manufactured by Coulter Electronics, Inc.) is used as a measuring device. An interface (manufactured by Nikkaki k.k.) that outputs number distribution and volume distribution and a personal computer CX-1 (manufactured by Canon Inc.) are connected. As an electrolytic solution, an aqueous 1% NaCl solution is prepared using first-grade sodium chloride. Measurement is carried out by adding as a dispersant 0.1 ml to 5 ml of a surface active agent, preferably an alkylbenzene sulfonate, to 100 ml to 150 ml of the above aqueous electrolytic solution, and further adding 2 mg to 20 mg of a sample to be measured. The electrolytic solution in which the sample has been suspended is subjected to dispersion for about 1 minute to about 3 minutes in an ultrasonic dispersion machine. The volume distribution and number distribution of particles of 2 μm to 40 μm are calculated by measuring the volume and number of colored resin particles or toner particles by means of the above Coulter counter Type TA-II, using an aperture of 100 μ as its aperture. Then the values according to the present invention are determined, which are the weight-based, weight average particle diameter $\bar{d}4$ determined from the volume distribution (where the middle value of each channel is used as the representative value for each channel), the weight-based, coarse-powder content (16.0 μm or larger) determined from the volume distribution, and the number-based, fine-powder particle number (5.04 μm or smaller) determined from the number distribution.

In the present invention, it is preferred to use an electrically insulative resin as a coat resin on the surface of the carrier. The coat resin may be appropriately selected depending on materials for the toner and core materials for the carrier. In the present invention, in order to improve the properties of adhesion to the surfaces of carrier cores, the coat resin must contain at least one acrylic monomer selected from acrylic acid (or its ester) monomers and methacrylic acid (or its ester) monomers. In particular, when the polyester resin particles with a high negative chargeability are used as the toner material, a styrene monomer may preferably be further used to form a copolymer, for the purpose of stabilizing chargeability.

Its copolymerization weight ratio may preferably be such that the acrylic monomers are in an amount of 5% by weight to 70% by weight, the styrene monomers are in an amount of 95% by weight to 30% by weight. More preferably the copolymerization ratio of the styrene monomers should preferably be controlled to be in an amount of not less than 50% by weight, and more preferably not less than 70% by weight.

With regard to the average molecular weight of the above copolymer, the copolymer may preferably have a number average molecular weight of 10,000 to 35,000, and more preferably 17,000 to 24,000, and a weight average molecular weight of 25,000 to 100,000, and more preferably 49,000 to 55,000, taking account of the coating uniformity and coating strength on the surfaces of carrier cores.

The monomers usable in the present invention for the coat resin of the carrier cores may include styrene monomers such as styrene, chlorostyrene, α-methylstyrene and styrene-chlorostyrene; and acrylic monomers including acrylic acid esters such as methyl acrylate, ethyl acrylate, butyl acrylate, octyl acrylate, phenyl acrylate and 2-ethylhexyl acrylate, and methacrylic acid esters such as methyl methacrylate, ethyl methacrylate, butyl methacrylate and phenyl methacrylate.

As the carrier cores (magnetic particles) used in the present invention, it is possible to use, for example, metals such as surface-oxidized or unoxidized iron, nickel, copper, zinc, cobalt, manganese, chromium and rare earth elements, or alloys or oxides thereof. There are no particular limitations on the method of producing them.

In particular, it is preferred to use magnetic ferrite particles as the carrier cores. In view of surface homogeniety and coating stability, it is more preferred to use magnetic ferrite carrier cores wherein 98% or more of cores have metal composition of Cu-Zn-Fe in metal compositional ratio of 5 to 20:5 to 20:30 to 80, on the basis of total metal elements in the ferrite.

In the two-component developer of the present invention, it is preferred for the coat resin on the carrier core surfaces to contain not less than 50% by weight of styrene as monomer composition and have a volume resistivity of $10^8\Omega\cdot$cm to $10^{16}\Omega\cdot$cm.

The coat resin may preferably satisfy the condition of $A<B$ when the quantity of triboelectricity obtained in an environment of 15° C./10% RH by triboelectric charging between the coat resin and the carrier cores is represented by A μc/g and the quantity of triboelectricity in an environment of 30° C./80% RH is represented by B μc/g.

The coat resin and the carrier cores should also have the relationship of $-130\ \mu c/g \leqq A<B \leqq +100\ \mu c/g$, and preferably $-120\ \mu c/g \leqq A<B \leqq +10\ \mu c/g$, and have a value of $|A/B|$ of not less than 1.5, and preferably 1.5 to 20.

The above ranges correlate with the triboelectric chargeability of the colored resin particles. In particular, when the quantity of triboelectricity obtained in an environment of 15° C./10% RH by triboelectric charging between the non-magnetic colored resin particles and the carrier cores is represented by C μc/g and the quantity of triboelectricity in an environment of 30° C./80% RH is represented by D μc/g, the relationships of;

$$C<D<0$$

and $1.1 \leqq C/D \leqq 3$ (preferably $1.5 \leqq C/D \leqq 2.5$) can be more effective.

In the present invention, the particle surfaces of the carrier used may preferably be coated with the resin used in an amount of 0.05% by weight to 10% by weight based on the weight of carrier cores, and the carrier particles may preferably have a weight average particle diameter of 25 μm to 65 μm.

A method of producing the resin-coated carrier may include a method in which a coating material such as resin is dissolved or suspended in a solvent and the resulting solution or suspension is adhered to the surfaces of carrier core particles by coating, and a method in which powders are merely mixed.

When the two-component developer is prepared by mixing the toner according to the present invention and the carrier, good results can be usually obtained by mixing them in such a proportion that the toner is in a concentration of 2% by weight to 10% by weight, preferably 3% by weight to 9% by weight, in the developer. A toner concentration less than 2% by weight tends to result in a lowering of image density, and on the other hand a toner concentration more than 10% by weight may result in an increase in fog or in-drive toner scatter to tend to shorten the service life of the developer.

In the case when the toner of the present invention comprises a magnetic toner, the organic resin particles may preferably be contained in the magnetic toner in an amount of 0.1% by weight to 5.0% by weight so that the cleaning performance can be surely exhibited and a stable chargeability can be achieved.

The organic resin particles also has a function of protecting a photosensitive member, and is useful for elongating the lifetime of the photosensitive member. For example, in the case of an organic photosensitive member tending to be scraped because of its relatively low surface hardness, the organic resin particles can reduce scrapings on the surface to bring about an improvement in durability. In the case of a photosensitive member having less scratch resistance, like an amorphous silicon photosensitive member, the organic resin particles can prevent occurrence of scratches and contribute the maintenance of initial characteristics.

As the magnetic fine particles contained in the magnetic toner according to the present invention, a substance capable of being magnetized when placed in an magnetic field is used. It is possible to use powder of a ferroelectric metal such as iron, cobalt or nickel, or an alloy or compound such as magnetite, $\gamma$-$Fe_2O_3$ or ferrite.

These magnetic fine particles may preferably be a magnetic powder with a BET specific surface area of preferably 1 $m^2/g$ to 20 $m^2/g$, and particularly 2.5 $m^2/g$ to 12 $m^2/g$, as measured by nitrogen adsorption, and also a Mohs hardness of 5 to 7. This magnetic powder should be contained in an amount of 10% by weight to 70% by weight based on the weight of the toner.

In the present invention, the magnetic colored resin particles may preferably have a weight average particle diameter ($\bar{d}4$) of 4 μm to 15 μm, and more preferably 5 μm to 10 μm.

When the non-magnetic color toner of the present invention is used in a one-component developing system, the non-magnetic color toner may preferably be applied to an image forming method in which, using an image forming apparatus comprising;

a developer carrying member, and a feed roller for feeding a toner to said the developer carrying member and a developer coating blade provided on the downstream side of the feed roller which are provided in pressure contact with said developer carrying member;

the surface of said developer carrying member comprising a resin layer containing at least fine particles comprising a solid lubricant such as graphite;

a latent image is developed by the toner at a developing zone defined by said developer carrying member and a latent image bearing member provided opposingly thereto, while applying a DC/AC overlay electric field.

Figure 2:
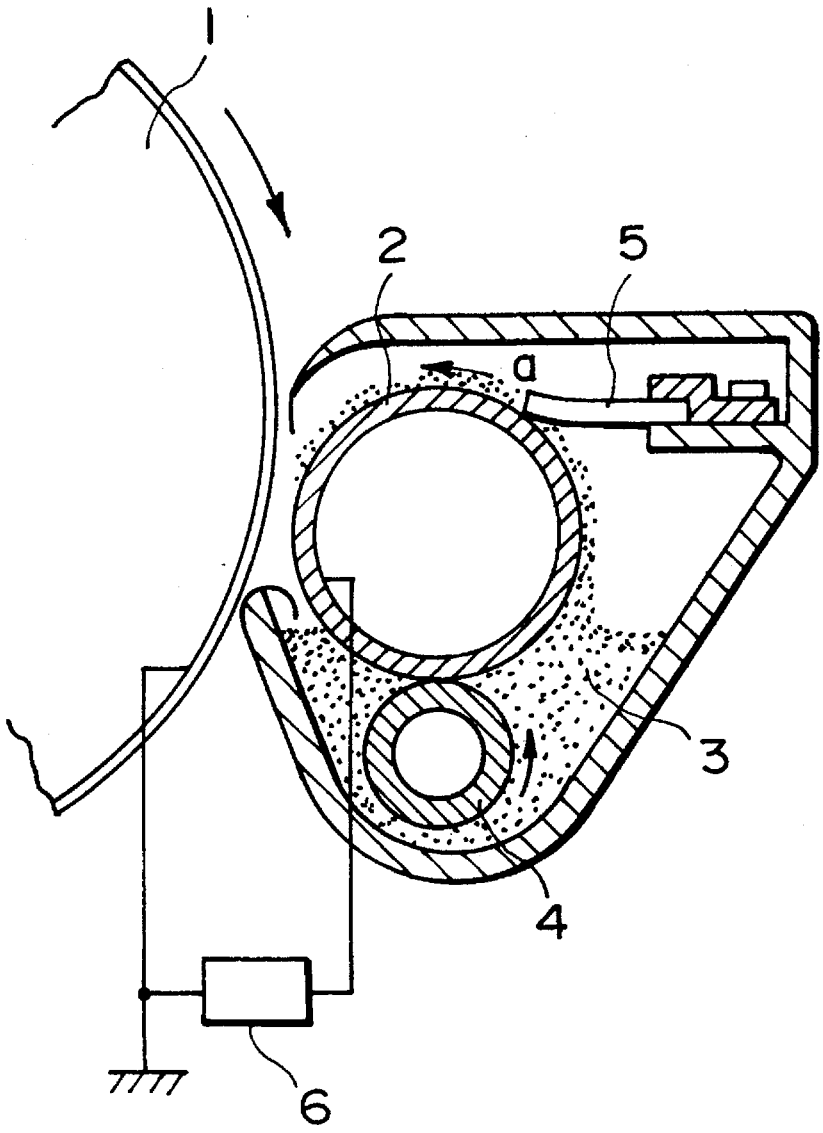
FIG. 2 is a schematic illustration of an example of a developing apparatus used in the image forming method of the present invention.

An example of the image forming apparatus used in the present invention will be described below with reference to FIG. 2, to which the example is by no means limited. FIG. 2 illustrates an apparatus for developing an electrostatic image formed on a latent image bearing member. The numeral 1 denotes the latent image bearing member, on which a latent image is formed through an electrophotographic process means or electrostatic recording means (not shown). The numeral 2 denotes the developer carrying member, comprised of a non-magnetic sleeve made of non-magnetic metal such as stainless steel. The non-magnetic color toner is reserved in a hopper 3, and fed onto the developer carrying member 2 by means of a feed roller 4. The feed roller 4 also takes off the toner remaining on the developer carrying member 2 after development. The toner fed onto the developer carrying member 2 is coated in a uniform and thin layer by means of a developer coating blade 5. It is effective for the developer coating blade 5 and the developer carrying member 2 to be brought into contact at a contact pressure of 3 g/cm to 250 g/cm, and preferably 10 g/cm to 120 g/cm, as a linear pressure in the mother line direction of the sleeve. A contact pressure smaller than 3 g/cm tends to make it difficult for the toner to be uniformly coated and tends to result in a broad distribution of charges of the toner to cause fog or toner scatter. A contact pressure larger than 250 g/cm is not preferable since the toner tends to undergo agglomeration or pulverization because of a large pressure applied to the toner. The adjustment of the contact pressure in the range of 3 g/cm to 250 g/cm makes it possible to disintegrate the agglomeration peculiar to toners with small particle diameter, and makes it possible to instantaneously raise the charges of the toner. As the developer coating blade 5, it is preferred to use a blade made of a material of a triboelectric series suited for the toner to be electrostatically charged in the desired polarity.

In the present invention, silicone rubber, urethane rubber, styrene-butadiene rubber, etc. are preferred. Use of a conductive rubber is preferable since the toner can be prevented from being charged in excess.

A method of forming on the sleeve surface the resin layer containing a solid lubricant will be described below.

Coat forming methods commonly used may include dipping, spraying, roll coating, curtain coating, and sputtering. In particular, in order to provide the coat of the present invention, the dipping and the spraying are advantageous. Stated specifically, in the spraying, a coating resin as a solid content is dissolved in a solvent, and the contents are mixed together with glass beads, which are then dispersed using a paint shaker. Thereafter, the dispersion is filtered with a mesh made of nylon to give a coating composition. This coating composition is applied to a sleeve cylinder by air spraying in a uniform thickness followed by drying at an elevated temperature.

In view of performance and manufacture, the resin layer may preferably be made to have a thickness of 0.5 μm to 30 μm. The solid lubricant may preferably have particle diameters of 0.1 μm to 10 μm, and should be used in an amount of 1 part by weight to 20 parts by weight based on 10 parts by weight of the resin component.

In the system in which the toner is coated in a thin layer onto the developer carrying member by means of the blade as proposed in the present invention, in order to obtain a sufficient image density, the thickness of the toner layer formed on the developer carrying member must be made smaller than the length of clearance at which the developer carrying member and the latent image bearing member are opposed, and an alternating electric field must be applied to this clearance.

Using a bias electric source 6 as shown in FIG. 2, an alternating electric field, or a developing bias comprised of an alternating electric field and a direct-current electric field overlaid thereon, is applied across the developer carrying member and the latent image bearing member, whereby the toner can be moved with ease from the surface of the developer carrying member to the surface of the latent image bearing member and also an image with a good quality can be obtained.

An alternating-current bias for forming the alternating electric field may have a frequency f of 200 Hz to 4,000 Hz, and preferably 800 Hz to 3,000 Hz, and a peak-to-peak voltage Vpp of 500 V to 3,000 V.

The latent image bearing member preferably used is an organic photosensitive member having a surface layer containing a fluorine-containing resin powder in an amount of 5% by weight to 40% by weight.

Fluorine-containing resin particles incorporated in the surface layer of the photosensitive member may preferably be one or more kinds appropriately selected from tetrafluroethylene resin, trifluorochloroethylene resin, hexafluoroethylene-propylene resin, vinyl fluoride resin, vinylidene fluoride resin, difluorodichloroethylene resin, and copolymers of any of these. In particular, tetrafluoroethylene resin and vinylidene fluoride resin are preferred. Molecular weight or particle diameter of the resin may be appropriately selected.

Methods of measuring the respective physical properties will be described below.

Figure 3:
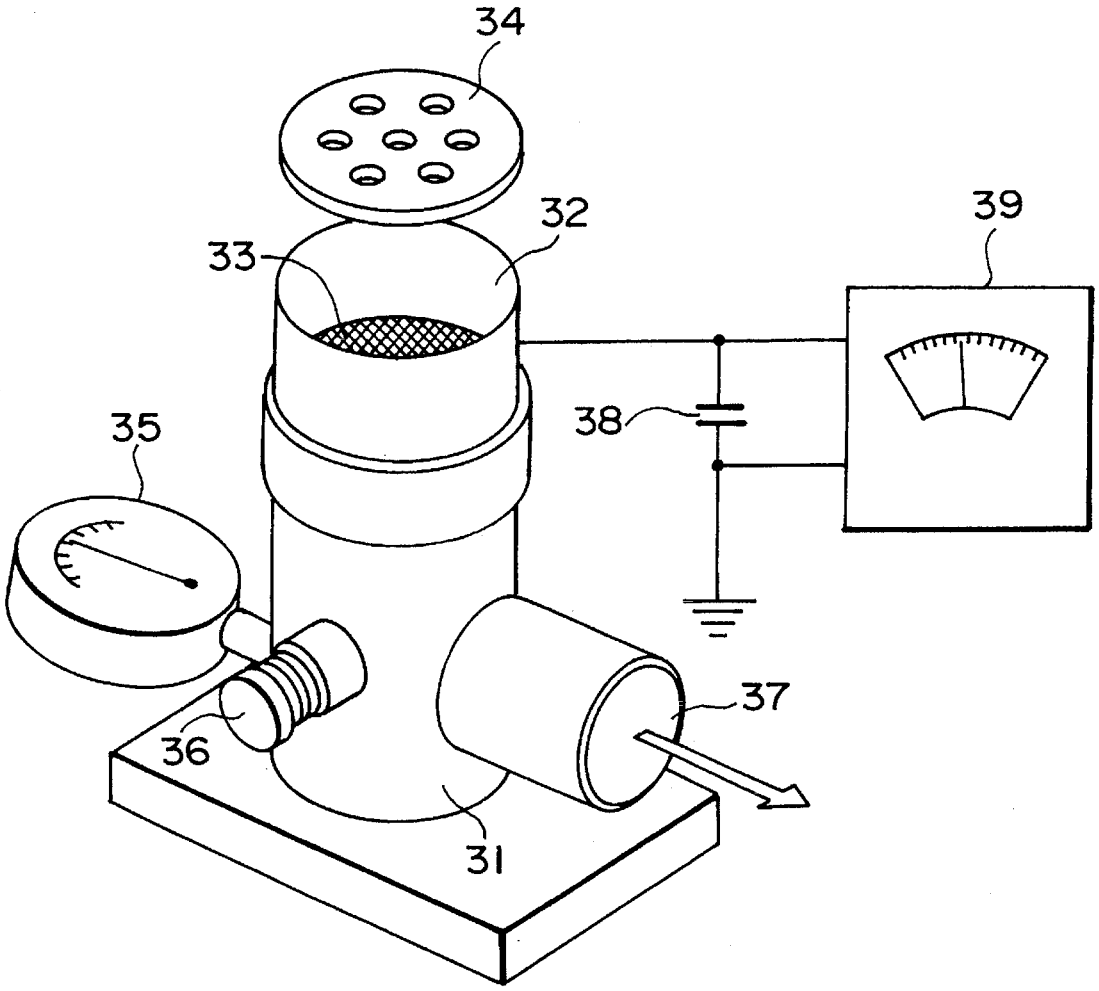
FIG. 3 is a schematic illustration of an apparatus for measuring the quantity of triboelectricity of a powdery sample.

(1) Measurement of triboelectric charges:

FIG. 3 illustrates an apparatus for measuring the quantity of triboelectricity of the additives, colored resin particles or toner. A mixture of the colored resin particles or toner the quantity of triboelectricity of which is to be measured and the carrier in weight ratio of 1:19 (or a 1:99 mixture in the case of additives such as fine titanium oxide powder) is put in a bottle made of polyethylene, with a volume of 50 to 100 ml, and manually shaked for about 10 to 40 seconds. About 0.5 to 1.5 g of the resulting mixture is put in a measuring container 32 made of a metal at the bottom of which a screen 33 of 500 meshes is provided, and the container is covered with a plate 34 made of a metal. The total weight of the measuring container 32 in this state is weighed and is expressed as $W_1$ (g). Next, in a suction device 31 (made of an insulating material at least at the apart coming into contact with the measuring container 32), air is sucked from a suction opening 37 and an air-flow control valve 36 is operated to control the pressure indicated by a vacuum indicator 35 to be 250 mmHg. In this state, suction is sufficiently carried out (preferably for about 2 minutes) to remove the additives, colored resin particles or toner by suction. The potential indicated by a potentiometer 39 at this time is expressed as V (volt). The numeral 38 denotes a capacitor, whose capacitance is expressed as C (μF). The total weight of the measuring container after completion of the suction is also weighed and is expressed as $W_2$ (g). The quantity of triboelectricity (μc/g) of the additives, colored resin particles or toner is calculated as shown by the following equation.

$$\text{Quantity of triboelectricity } (\mu c/g) \text{ of the sample} = \frac{C \times V}{W_1 - W_2}$$

The measurement is carried out under conditions of 23° C. and 60% RH. The carrier used for the measurement is the coated-ferrite carrier or iron powder carrier according to the present invention, containing 70 to 90% by weight of carrier particles of 250 mesh-pass and 350 mesh-on.

(2) Specific volume resistance:

i) Pellets (20 mm in diameter×2 to 3 mm in thickness) are prepared from a sample by pressure molding under a load of 10 t for 30 seconds.

ii) The pellets obtained are left to stand for 24 hours in a chamber with an environment of a temperature of 22° C. and a humidity of 55% RH.

iii) Using TR-8601 HIGH MECOHM METER, manufacture by Takeda Riken Co., resistivities are measured with changes of electric fields, and the values at 1 kV/cm are read by plotting the data.

(3) Method of measuring particle size of the organic resin particles:

Apparatus

A Coulter counter Type-N4 is used as a measuring apparatus, and UD-200, manufactured by Tomy Seiko Co., is used as a dispersing ultrasonic generator.

Measuring method

In 30 to 50 ml of distilled water to which a surface active agent has been added in a trace amount, a sample is charged in a suitable amount (for example, about 1 mg). Using the above ultrasonic generator, the sample is dispersed for about 2 to 5 minutes at an output of 2 to 6. A suspension in which the sample has been dispersed is transferred to a cell, and, after air bubbles have been let out, the suspension is set in the above Coulter counter Type-N4 whose measuring temperature has been kept at 50° C. The sample is maintained for 10 to 20 minutes so that it can be kept at a constant temperature, and thereafter the measurement is started to determine particle size distribution.

(4) Measurement of glass transition point Tg:

In the present invention, the glass transition point is measured using a differential scanning calorimeter (DSC), DSC-7 (manufactured by Perkin-Elmer Inc.).

A sample to be measured is precisely weighed in a quantity of 5 to 20 mg, and preferably 10 mg.

This is put in an aluminum pan. Using an empty aluminum pan as a reference, the measurement is carried out in an environment of normal temperature and normal humidity at a measuring temperature range between 30° C. to 200° C., raised at a rate of 10° C./min.

Figure 4:
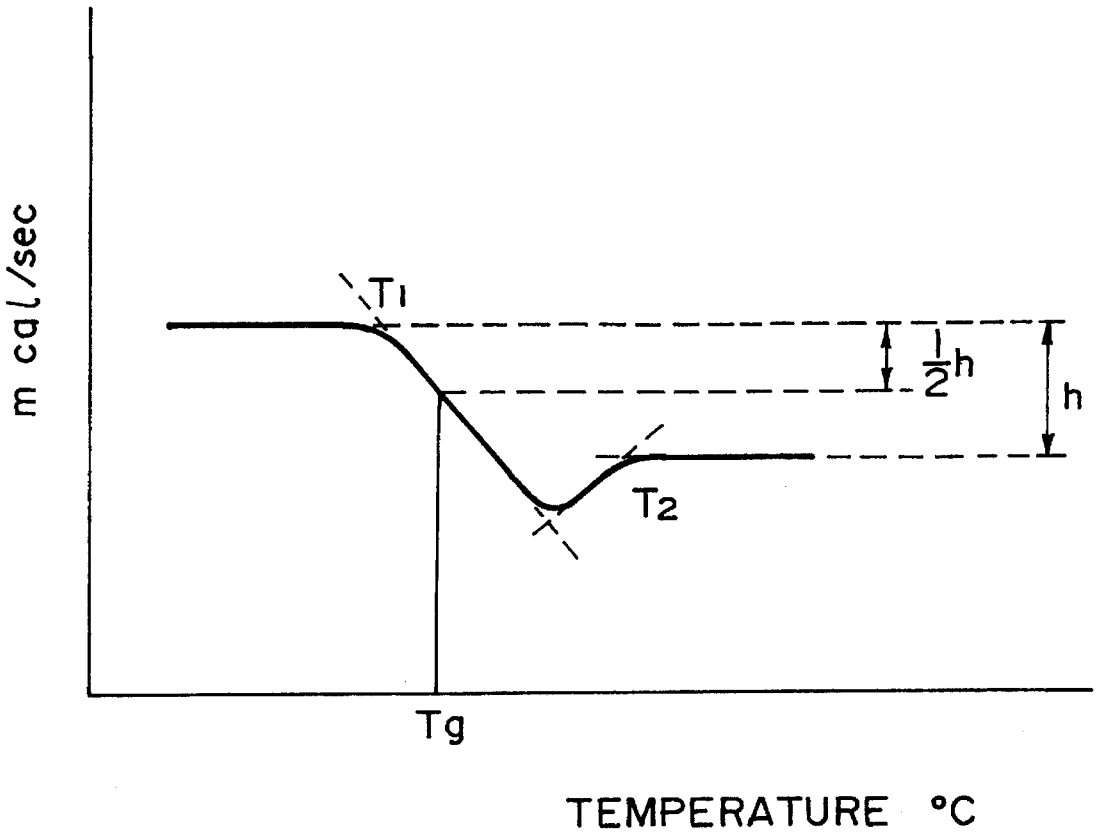
FIG. 4 is an explanatory view for the measurement of the glass transition point of a binder resin or a toner.

During this temperature rise, an endothermic peak of the main peak in the range of temperatures 40° C. to 100° C. is obtained. The point at which the line at a middle point of the base lines before and after appearance of the endothermic peak and the differential thermal curve intersect is regarded as the glass transition point Tg in the present invention (FIG. 4).

(5) Measurement of molecular weight:

In the present invention, the maximum values in the molecular weight on the chromatogram obtained by GPC (gel permeation chromatography) are measured under the following conditions.

Columns are stabilized in a heat chamber of 40° C. To the columns kept at this temperature, THF (tetrahydrofuran) as a solvent is flowed at a flow rate of 1 ml per minute, and 50 μl to 200 μl of a THF sample solution of a resin prepared to have a sample concentration of 0.05% by weight to 0.6% by weight is injected thereinto to make measurement. In measuring the molecular weight of the sample, the molecular weight distribution ascribed to the sample is calculated from the relationship between the logarithmic value and count number of a calibration curve prepared using several kinds of monodisperse polystyrene standard samples. As the standard polystyrene samples used for the preparation of the calibration curve, it is suitable to use, for example, samples with molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, which are available from Pressure Chemical Co. or Toyo Soda Manufacturing Co., Ltd., and to use at least about 10 standard polystyrene samples. An RI (refractive index) detector is used as a detector.

Columns should be used in combination of a plurality of commercially available polystyrene gel columns so that the regions of molecular weights of from $10^3$ to $2\times10^6$ can be accurately measured. For example, they may preferably comprise a combination of μ-Styragel 500, $10^3$, $10^4$ and $10^5$, available from Waters Co.; Shodex KF-80M or a combination of KF-801, 803, 804 and 805, or a combination of KA-802, 803, 804 and 805, available from Showa Denko K.K.; or a combination of TSKgel G1000H, G2000H, G2500H, G3000H, G4000H, G5000H, G6000H, G7000H and GMH, available from Toyo Soda Manufacturing Co., Ltd.

The present invention will be described below in greater detail by giving Examples. In the following "%" and "part(s)" indicate "% by weight" and "part(s) by weight", respectively.

EXAMPLE 1

| | |
|---|---|
| Polyester resin obtained by condensation of propoxylated bisphenol and fumaric acid (weight average molecular weight: about 17,000) | 100 parts |
| Phthalocyanine pigment | 4 parts |
| Chromium complex of di-tert-butylsalicylic acid | 2 parts |

The above materials were preliminarily thoroughly mixed using a Henschel mixer, and then melt-kneaded at least twice using a three-roll mill. After cooled, the kneaded product was crushed using a hammer mill to give coarse particles of about 1 to 2 mm in diameter, which were then finely pulverized using a fine grinding mill of an air-jet system. The resulting finely pulverized product was classified and particles with particle diameters of 2 to 10 μm were mainly collected. Resin particles containing a coloring agent were thus obtained.

A cyan toner was prepared by blending 100 parts of the above coloring agent-containing resin particles, 0.5 part of acrylic resin particles (having a peak at about 120,000 in molecular weight distribution) produced from methyl methacrylate, having two peaks at particle diameters of 40 mμ and 500 mμ in their particle size distribution (see FIG. 1), containing smaller-diameter particles with particle diameters of 20 to 200 mμ in an amount of 92% by weight and larger-diameter particles with particle diameters of 300 to 800 mμ in an amount of 8% by weight and having a volume resistivity of $3\times10^{10}\Omega\cdot$cm, and 0.6 part of fine titanium oxide powder with a BET specific surface area of 70 $m^2/g$.

The cyan toner thus prepared had a weight average particle diameter ($\bar{d}4$) of 8.2 μm, contained coloring agent-containing resin particles with particle diameters not larger than 5 μm in an amount of 29% by number, contained coloring agent-containing resin particles with particle diameters of 12.7 to 16 μm in an amount of 2.0% by weight, and contained coloring agent-containing resin particles with particle diameter not smaller than 16 μm in an amount of substantially 0% by weight, where the % by number (N) of coloring agent-containing resin particles with particle diameters of 6.35 to 10.1 μm was 47% by number and the % by weight (V) of coloring agent-containing resin particles with particle diameters of 6.35 to 10.1 μm was 68% by weight. Therefore the particle size distribution:

$$\frac{V \times \bar{d}4}{N}$$

of the cyan toner was 11.9.

As a carrier, a resin-coated carrier comprised of Cu-Zn-Fe (15:15:70) magnetic ferrite carrier cores coated with 0.5% by weight of a styrene resin was used. This magnetic ferrite carrier cores had a weight average particle diameter of 45 μm, and contained particles with particle diameters not larger than 35 μm in an amount of 4.2% by weight, particles with particle diameters of 35 to 40 μm in an amount of 9.5% by weight, particles with particle diameters of 40 to 74 μm in an amount of 86.1% by weight and particles with particle diameters not smaller than 74 μm in an amount of 0.2% by weight. The styrene resin used was a styrene/methyl methacrylate/2-ethylhexyl acrylate copolymer (copolymerization weight ratio: 50:20:30; number average molecular weight: 21,250; weight average molecular weight: 52,360).

Next, 5 parts by weight of the cyan toner and 100 parts by weight of the resin-coated ferrite carrier were blended. A two-component developer for cyan was thus prepared.

This two-component developer was applied in a commercially available plain-paper color copier (Color Laser Copier 500, manufactured by Canon Inc.) provided with an OPC photosensitive member of a laminate type and a cleaning blade formed of polyurethane rubber, and an image was reproduced in an environment of a temperature of 23° C. and a humidity of 65% RH, setting development contrast at 270 V. The toner image thus obtained was in a density of as high as 1.51, free from fog, and sharp. Copies were taken on 10,000 sheets, during which density decreased by as small as 0.06 and the same fog-free, sharp images as those at the initial stage were obtained. In an environment of low temperature and low humidity (temperature: 20° C.; humidity: 10% RH), images were reproduced setting the development contrast at 330 V. As a result, image density was 1.49, suggesting that the toner and developer of the present invention were effective in the controlling of the quantity of triboelectricity in an environment of low humidity.

In an environment of high temperature and high humidity (temperature: 30° C.; humidity: 80% RH), images were reproduced setting the development contrast at 250 V. As a result, image density was 1.53 and very stable and good toner images were obtained.

Image reproduction was also tested after the developer was left to stand for 1 month in each environment of temperature 23° C./humidity 60% RH, temperature 20° C./humidity 10% RH and temperature 30° C./humidity 80% RH. As a result, good toner images were obtained also in initial images.

EXAMPLE 2

A toner and a two-component developer were prepared in the same manner as in Example 1 except for use of the same acrylic resin particles but having peaks at particle diameters of 85 mμ and 600 mμ in their particle size distribution, and containing smaller-diameter particles with particle diameters of 20 to 200 mμ in an amount of 88% by weight and larger-diameter particles with particle diameters of 300 to 800 mμ in an amount of 12% by weight. Image reproduction was also tested in the same manner as in Example 1.

Toner images were obtained in image densities of 1.38 to 1.47 in an environment of temperature 20° C./humidity 10% RH, image densities of 1.43 to 1.52 in an environment of temperature 23° C./humidity 65% RH, and image densities of 1.50 to 1.59 in an environment of temperature 30° C./humidity 80% RH. Although environment characteristics were slightly lower than those in Example 1, good results were obtained.

EXAMPLE 3

A toner and a two-component developer were prepared in the same manner as in Example 1 except that 0.5 part by weight of the acrylic resin particles as used in Example 1 and 0.5 part by weight of a hydrophobic fine silica powder (BET specific surface area: 230 $m^2/g$) having been treated with hexamethyldisilazane were used as additives. Images were also reproduced in the same manner as in Example 1.

Toner images were obtained in image densities of 1.36 to 1.49 in an environment of temperature 20° C./humidity 10% RH, image densities of 1.45 to 1.56 in an environment of temperature 23° C./humidity 65% RH, and image densities of 1.51 to 1.62 in an environment of temperature 30° C./humidity 80% RH. Although environment characteristics were slightly lower than those in Example 1, good results were obtained.

COMPARATIVE EXAMPLE 1

A toner and a two-component developer were prepared in the same manner as in Example 1 except that acrylic resin particles produced from methyl methacrylate, comprising particles with particle diameters of 16.9 to 53.3 mμ having a peak at a particle diameter of 44 mμ, containing no larger-diameter particles with particle diameters of 300 to 800 mμ and having a volume resistivity of $3\times10^{10}\Omega\cdot$cm was used as an additive. Image reproduction was tested in the same manner as in Example 1. Uneven toner images occurred after running on about 7,000 sheets in an environment of temperature 20° C./humidity 10% RH. After further running up to 10,000 sheets, the surface of the photosensitive drum was examined to reveal that a talc component contained in transfer paper was recognized, where faulty cleaning was seen to have occurred.

COMPARATIVE EXAMPLE 2

A toner and a two-component developer were prepared in the same manner as in Example 1 except that acrylic resin particles produced from methyl methacrylate, having peaks at particle diameters of 50 mμ and 950 mμ, and containing smaller-diameter particles in an amount of 70% by weight and larger-diameter particles with particle diameters not smaller than 300 mμ in an amount of 30% by weight were used as an additive. Images were reproduced in the same manner as in Example 1. As a result, fog occurred in an environment of temperature 20° C./humidity 10% RH.

COMPARATIVE EXAMPLE 3

A toner and a two-component developer were prepared in the same manner as in Example 1 except that the acrylic resin particles were not used. Images were reproduced in the same manner as in Example 1. As a result, image density became lower in an environment of temperature 20° C./humidity 10% RH, where the image density was 1.38 at the initial stage but came to be 1.15 on 2,000 sheet running.

According to the present invention, the stability of triboelectric chargeability of the toner can be improved and fog-free, good toner images can be obtained when the specific organic resin particles are used as an additive in the two-component developer comprising a color toner and a carrier.

EXAMPLE 4

| | |
|---|---|
| Polyester resin obtained by condensation of propoxylated bisphenol and fumaric acid (weight average molecular weight: about 17000) | 100 parts |
| Phthalocyanine pigment | 4 parts |
| Chromium complex of di-tert-butylsalicylic acid | 2 parts |

The above materials were preliminarily thoroughly mixed using a Henschel mixer, and then melt-kneaded at least twice using a three-roll mill. After cooled, the kneaded product was crushed using a hammer mill to give coarse particles of about 1 to 2 mm in diameter, which were then finely pulverized using a fine grinding mill of an air-jet system. The resulting finely pulverized product was classified and particles with particle diameters of 2 to 10 μm were mainly collected. Resin particles containing a coloring agent were thus obtained.

A cyan toner was prepared by blending 100 parts of the above coloring agent-containing resin particles, 0.5 part of acrylic resin particles comprised of a styrene/methyl methacrylate copolymer, having peaks at particle diameters of 55 mμ and 500 mμ in their particle size distribution, containing the smaller-diameter particles in an amount of 80% by weight and the larger-diameter particles in an amount of 20% by weight and having a volume resistivity of $3\times10^{10}\Omega\cdot$cm, and 0.5 part of a hydrophilic fine titanium oxide powder with a BET specific surface area of 70 $m^2/g$.

The cyan toner thus prepared had a weight average particle diameter ($\bar{d}4$) of 8.0 μm, contained coloring agent-containing resin particles with particle diameters not larger than 5 μm in an amount of 31% by number, contained coloring agent-containing resin particles with particle diameters of 12.7 to 16 μm in an amount of 1.7% by weight, and contained coloring agent-containing resin particles with particle diameter not smaller than 16 μm in an amount of substantially 0% by weight, where the % by number (N) of coloring agent-containing resin particles with particle diameters of 6.35 to 10.1 μm was 46% by number and the % by weight (V) of coloring agent-containing resin particles with particle diameters of 6.35 to 10.1 μm was 64% by weight. Therefore the particle size distribution:

$$\frac{V\times\bar{d}4}{N}$$

of the cyan toner was 11.1.

As a carrier, a resin-coated carrier comprised of Cu-Zn-Fe (15:15:70) magnetic ferrite carrier cores coated with 0.5% by weight of a styrene resin was used. This magnetic ferrite carrier cores had a weight average particle diameter of 45 μm, and contained particles with particle diameters not larger than 35 μm in an amount of 4.2% by weight, particles with particle diameters of 35 to 40 μm in an amount of 9.5% by weight, particles with particle diameters of 40 to 74 μm in an amount of 86.1% by weight and particles with particle diameters not smaller than 74 μm in an amount of 0.2% by weight. The styrene resin used was a styrene/methyl methacrylate/2-ethylhexyl acrylate copolymer (copolymerization weight ratio: 50:20:30; number average molecular weight: 21,250; weight average molecular weight: 52,360).

Next, 5 parts by weight of the cyan toner and 100 parts by weight of the resin-coated ferrite carrier were blended. A two-component developer for cyan was thus prepared.

This two-component developer was applied in a commercially available plain-paper color copier (Color Laser Copier 500, manufactured by Canon Inc.), and an image was reproduced in an environment of 23° C./65% RH, setting development contrast at 300 V. The toner image thus obtained was in an image density of as high as 1.47, free from fog, and sharp. Copies were further taken on 10,000 sheets, during which density decreased by as small as 0.15 and the same fog-free, sharp images as those at the initial stage were obtained. In an environment of low temperature and low humidity (20° C., 10% RH), images were reproduced setting the development contrast at 320 V. As a result, image density was as high as 1.48, showing that the quantity of triboelectricity was effectively controlled in an environment of low humidity.

In an environment of high temperature and high humidity (30° C., 80% RH), images were reproduced setting the development contrast at 270 V. As a result, image density was 1.55 and very stable and good toner images were obtained.

Image reproduction was also tested after the two-component developer was left to stand for 1 month in each environment of temperature 23° C./humidity 60% RH, temperature 20° C./humidity 10% RH and temperature 30° C./humidity 80% RH. As a result, no undesirable changes were seen also in initial images.

EXAMPLE 5

A toner and a developer were prepared in the same manner as in Example 4 except that as an additive the hydrophilic fine titanium oxide powder with a BET specific surface area of 70 $m^2/g$ used in Example 4 was replaced with a hydrophilic fine aluminum oxide powder with a BET specific surface area of 100 $m^2/g$ prepared by the gaseous phase process. Images were also reproduced in the same manner as in Example 4. Image densities were 1.6 to 1.65 in an environment of 30° C./80% RH. Although the image densities were slightly higher than those in Example 4, good results were obtained.

EXAMPLE 6

A toner and a developer were prepared in the same manner as in Example 4 except that as an additive the hydrophilic fine titanium oxide powder with a BET specific surface area of 70 m2/g used in Example 4 was replaced with a fine titanium oxide powder having been subjected to hydrophobic treatment with an aliphatic surface active agent. Images were also reproduced in the same manner as in Example 4. Although image densities were slightly as low as 1.35 to 1.45 in an environment of 20° C./10% RH, good results were obtained.

EXAMPLE 7

A toner and a developer were prepared in the same manner as in Example 4 except that 0.5 part of the acrylic resin particles as used in Example 4 and 0.5 part of fine silica powder (BET specific surface area: 170 $m^2/g$) having been treated with dimethyldichlorosilane were used as additives. Images were also reproduced in the same manner as in Example 4. As a result, good toner images were obtained in image densities of 1.25 to 1.35 in an environment of 20° C./10% RH, image densities of 1.50 to 1.60 in an environment of 23° C./65% RH, and image densities of 1.70 to 1.80 in an environment of 30° C./80% RH, although environment characteristics were slightly lower than those in Example 4.

COMPARATIVE EXAMPLE 4

A toner and a developer were prepared in the same manner as in Example 4 except that the acrylic resin particles were not used. Images were reproduced in the same manner as in Example 4. As a result, fog occurred in an environment of 20° C./10% RH and also low image densities resulted.

EXAMPLE 8

A toner and a developer were prepared in the same manner as in Example 4 except that the fine aluminum oxide powder with a BET specific surface area of 100 $m^2/g$ prepared by the gaseous phase process in Example 5 was replaced with a fine aluminum oxide powder with a BET specific surface area of 150 $m^2/g$ prepared by the liquid phase process. Images were also reproduced in the same manner as in Example 4. As a result, good results were obtained.

COMPARATIVE EXAMPLE 5

The acrylic resin particles as used in Example 4 were disintegrated using a pulverizer of an air-jet system to prepare acrylic resin particles having a peak at a particle diameter of 50 mμ.

A toner and a developer were prepared in the same manner as in Example 4 except that this acrylic resin particles having a peak at a particle diameter of 50 mμ was used. Images were also reproduced in the same manner as in Example 4. Uneven images were slightly seen at halftone areas after running on 10,000 sheets in an environment of 30° C./80% RH. The part corresponding thereto on the photosensitive drum was examined to reveal that a low-resistance product contained in paper dust was adhered, where faulty cleaning was seen to have occurred.

Triboelectric charge performance and blade cleaning performance of the toners used in the above Examples and Comparative Examples are shown in Table 1.

Evaluation

A: Excellent

B: Good

C: Poor

X: Became halfway unable to continue the test

TABLE 1

| | Quantity of triboelectricity (μc/g) | | | Cleaning performance: Copied on 2,000 sheets | | | Cleaning performance: Copied on 10,000 sheets | | |
|---|---|---|---|---|---|---|---|---|---|
| | N/N | L/L | H/H | N/N | L/L | H/H | N/N | L/L | H/H |
| Example: | | | | | | | | | |
| 1 | −21.1 | −17.6 | −15.3 | A | A | A | A | A | A |
| 2 | −24.3 | −19.2 | −15.0 | A | A | A | A | A | A |
| 3 | −27.1 | −20.3 | −14.5 | A | A | A | A | A | A |
| 4 | −23.2 | −19.1 | −16.5 | A | A | A | A | A | A |
| 5 | −20.8 | −16.9 | −13.9 | A | A | A | A | A | A |
| 6 | −24.8 | −18.7 | −16.2 | A | A | A | A | A | A |
| 7 | −27.2 | −23.1 | −13.8 | A | A | A | A | A | A |
| 8 | −19.7 | −16.0 | −14.0 | A | A | A | A | A | A |
| Comparative Example: | | | | | | | | | |
| 1 | −22.0 | −18.1 | −15.5 | A | A | X | B | C | X |
| 2 | −23.8 | −19.1 | −17.2 | A | A | A | X | X | X |
| 3 | −29.8 | −20.3 | −15.9 | A | B | X | X | X | X |
| 4 | −30.8 | −21.1 | −17.2 | A | B | X | X | X | X |
| 5 | −22.1 | −18.7 | −16.0 | A | A | X | B | C | X |

N/N: Normal temperature/Normal humidity (23° C./65% RH)
L/L: Low temperature/Low humidity (20° C./10% RH)
H/H: High temperature/High humidity (30° C./80% RH)

REFERENCE EXAMPLE 9

| | |
|---|---|
| Polyester resin obtained by condensation of propoxylated bisphenol and fumaric acid (weight average molecular weight: about 17000) | 100 parts |
| Phthalocyanine pigment | 4 parts |
| Chromium complex of di-tert-butylsalicylic acid | 2 parts |

The above materials were preliminarily thoroughly mixed using a Henschel mixer, and then melt-kneaded using a twin-screw extruder type kneader. After cooled, the kneaded product was crushed using a hammer mill to give coarse particles of about 1 to 2 mm in diameter, which were then finely pulverized using a fine grinding mill of an air-jet system. The resulting finely pulverized product was classified and particles with particle diameters of 2 to 10 μm were mainly collected. Resin particles containing a coloring agent were thus obtained.

Cu-Zn-Fe magnetic ferrite carrier cores described later and the above coloring agent-containing resin particles were blended in an environment of temperature 15° C. and humidity 10% RH, and the quantity of triboelectricity C μc/g was measured to reveal that it was −40 μc/g. The quantity of triboelectricity D μc/g was also measured in an environment of temperature 30° C. and humidity 80% RH to reveal that it was −17 μc/g. Thus, the value of C/D was 2.35.

A cyan toner was prepared by blending 100 parts of the above coloring agent-containing resin particles, 0.3 part of acrylic resin particles comprised of a styrene/methyl methacrylate copolymer, having peaks at particle diameters of 55 mμ and 500 mμ in their particle size distribution, containing the smaller-diameter particles in an amount of 75% by weight and the larger-diameter particles in an amount of 25% by weight and having a volume resistivity of $3\times10^{10}\Omega\cdot$cm, and 0.5 part of a hydrophilic fine titanium oxide powder with a BET specific surface area of 70 $m^2/g$.

The cyan toner thus prepared had a weight average particle diameter ($\bar{d}4$) of 8.0 μm, contained coloring agent-containing resin particles with particle diameters not larger than 5 μm in an amount of 31% by number, contained coloring agent-containing resin particles with particle diameters of 12.7 to 16 μm in an amount of 17% by weight, and contained coloring agent-containing resin particles with particle diameter not smaller than 16 μm in an amount of substantially 0% by weight, where the % by number (N) of coloring agent-containing resin particles with particle diameters of 6.35 to 10.1 μm was 46% by number and the % by weight (V) of coloring agent-containing resin particles with particle diameters of 6.35 to 10.1 μm was 64% by weight. Therefore the particle size distribution:

$$\frac{V\times\bar{d}4}{N}$$

of the cyan toner was 11.1.

As a carrier, a resin-coated carrier comprised of Cu-Zn-Fe (15:15:70) magnetic ferrite carrier cores coated with 0.5% by weight of a styrene resin was used. This magnetic ferrite carrier cores had a weight average particle diameter of 45 μm, and contained particles with particle diameters not larger than 35 μm in an amount of 4.2% by weight, particles with particle diameters of 35 to 40 μm in an amount of 9.5% by weight, particles with particle diameters of 40 to 74 μm in an amount of 86.1% by weight and particles with particle diameters not smaller than 74 μm in an amount of 0.2% by weight. The styrene resin used was a styrene/methyl methacrylate copolymer (copolymerization weight ratio: 60:40). Using a mixed solvent of xylene and methyl ethyl ketone, the Cu-Zn-Fe magnetic ferrite carrier cores were coated with the styrene resin. The styrene/methyl methacrylate copolymer had a volume resistivity of $5\times10^{14}\Omega\cdot$cm, and was in a coating weight of 0.5% by weight.

The particles (average particle diameter: 60 mμ) of the styrene/methyl methacrylate copolymer used in the coat and the Cu-Zn-Fe magnetic ferrite carrier cores were blended to measure the quantity of triboelectricity. As a result, the quantity of triboelectricity A μc/g in an environment of temperature 15° C. and humidity 10% RH was −40 μc/g, and the quantity of triboelectricity B μc/g in an environment of temperature 30° C. and humidity 80% RH was +5 μc/g.

Next, 5 parts by weight of the toner and 100 parts by weight of the resin-coated ferrite carrier were blended. A two-component developer was thus prepared.

This two-component developer was applied in a commercially available plain-paper color copier (Color Laser Copier 500, manufactured by Canon Inc.), and an image was reproduced in an environment of 23° C./65% RH, setting development contrast at 300 V. The toner image thus obtained was in an image density of as high as 1.55, free from fog, and sharp. Copies were further taken on 10,000 sheets, during which density decreased by as small as 0.05 and the same fog-free, sharp images as those at the initial stage were obtained. In an environment of low temperature and low humidity (20° C., 10% RH), images were reproduced setting the development contrast at 300 V. As a result, image density was as high as 1.55, showing that the quantity of triboelectricity was effectively controlled in an environment of low humidity.

In an environment of high temperature and high humidity (30° C., 80% RH), images were reproduced setting the development contrast at 300 V. As a result, image density was 1.45 and very stable and good toner images were obtained.

Image reproduction was also tested after the developer was left to stand for 1 month in each environment of temperature 23° C./humidity 60% RH, temperature 20° C./humidity 10% RH and temperature 30° C./humidity 80% RH. As a result, no undesirable changes were seen also in initial images.

REFERENCE EXAMPLE 10

A toner and a developer were prepared in the same manner as in Reference Example 9 except that as an additive the hydrophilic fine titanium oxide powder with a BET specific surface area of 70 $m^2/g$ used in Reference Example 9 was replaced with a hydrophilic fine aluminum oxide powder with a BET specific surface area of 100 $m^2/g$ prepared by the gaseous phase process. Images were also reproduced in the same manner as in Reference Example 9. As a result, although toner scatter slightly occurred in an environment of 30° C./80% RH compared with Reference Example 9, good results were obtained.

REFERENCE EXAMPLE 11

A toner and a developer were prepared in the same manner as in Reference Example 9 except that as an additive the hydrophilic fine titanium oxide powder with a BET specific surface area of 70 $m^2/g$ used in Reference Example 9 was replaced with a fine titanium oxide powder having been subjected to hydrophobic treatment with a stearic acid surface active agent. Images were also reproduced in the same manner as in Reference Example 9. Although image density became slightly lower from 1.55 to 1.40 in an environment of 20° C./10% RH, good results were obtained.

REFERENCE EXAMPLE 12

A toner and a developer were prepared in the same manner as in Reference Example 9 except that 0.3 part of the acrylic resin particles as used in Example 9 and 0.5 part of fine silica powder (BET specific surface area: 170 $m^2/g$) having been treated with dimethyldichlorosilane were used as additives. Images were also reproduced in the same manner as in Reference Example 9. As a result, good toner images were obtained in image densities of 1.30 to 1.40 in an environment of 20° C./10% RH, image densities of 1.45 to 1.55 in an environment of 23° C./65% RH, and image densities of 1.55 to 1.65 in an environment of 30° C./80% RH, although environment characteristics were slightly lower than those in Reference Example 9.

COMPARATIVE EXAMPLE 6

A toner and a developer were prepared in the same manner as in Reference Example 9 except that the acrylic resin particles were not used. Images were reproduced in the same manner as in Reference Example 9. As a result, fog occurred in an environment of 20° C./10% RH and also low image densities resulted.

COMPARATIVE EXAMPLE 7

The acrylic resin particles as used in Reference Example 9 were thoroughly disintegrated using a pulverizer of an air-jet system to prepare acrylic resin particles having a peak at a particle diameter of 50 mμ.

A toner and a developer were prepared in the same manner as in Reference Example 9 except that this acrylic resin particles was used. Images were also reproduced in the same manner as in Reference Example 9. Uneven images were slightly seen at halftone areas after running on 10,000 sheets in an environment of 30° C./80% RH. The part corresponding thereto on the photosensitive drum was examined to reveal that a low-resistance product contained in paper dust was adhered, where faulty cleaning was seen to have occurred.

REFERENCE EXAMPLE 13

A toner and a developer were prepared in the same manner as in Reference Example 9 except that a styrene/butyl acrylate copolymer (copolymerization weight ratio: 50:50; quantity of triboelectricity A of the copolymer with an average particle diameter of 200 mμ: −30 μc/g: quantity of triboelectricity B: +2 μc/g; volume resistivity: $7\times10^{14}\Omega\cdot$cm) was used as the coat material of the ferrite carrier core particles. As a result, toner images were obtained in image densities of 1.45 to 1.55 in an environment of 23° C./65% RH, image densities of 1.50 to 1.55 in an environment of 20° C./10% RH, and image densities of 1.60 to 1.70 in an environment of 30° C./80% RH. Although environment characteristics were slightly lower in an environment of high humidity, good results were obtained.

REFERENCE EXAMPLE 14

| | |
|---|---|
| Polyester resin obtained by condensation of propoxylated bisphenol and fumaric acid (weight average molecular weight: about 17000) | 100 parts |
| Phthalocyanine pigment | 4 parts |
| Zinc complex of di-tert-butylsalicylic acid | 2 parts |

The above materials were preliminarily thoroughly mixed using a Henschel mixer, and then melt-kneaded using a twin-screw extruder type kneader. After cooled, the kneaded product was crushed using a hammer mill to give coarse particles of about 1 to 2 mm in diameter, which were then finely pulverized using a fine grinding mill of an air-jet system. The resulting finely pulverized product was then classified using a multi-division classifier and particles with particle diameters of 2 to 10 μm were mainly collected. Resin particles containing a coloring agent were thus obtained.

Cu-Zn-Fe magnetic ferrite carrier cores described later and the above coloring agent-containing resin particles were blended in an environment of temperature 15° C. and humidity 10% RH, and the quantity of triboelectricity C μc/g was measured to reveal that it was −15 μc/g. The quantity of triboelectricity D μc/g was also measured in an environment of temperature 30° C. and humidity 80% RH to reveal that it was −12 μc/g. Thus, the value of C/D was 1.25.

A cyan toner was prepared by blending 100 parts of the above coloring agent-containing resin particles, 0.3 part of acrylic resin particles comprised of a styrene/methyl methacrylate copolymer, having peaks at particle diameters of 55 mμ and 500 mμ in their particle size distribution, containing the smaller-diameter particles in an amount of 75% by weight and the larger-diameter particles in an amount of 25% by weight and having a volume resistivity of $3\times10^{10}\Omega\cdot$cm, and 0.5 part of a hydrophilic fine titanium oxide powder with a BET specific surface area of 70 m2/g.

The cyan toner thus prepared had a weight average particle diameter ($\bar{d}4$) of 7.5 μm, contained coloring agent-containing resin particles with particle diameters not larger than 5 μm in an amount of 35% by number, contained coloring agent-containing resin particles with particle diameters of 12.7 to 16 μm in an amount of 1.4% by weight, and contained coloring agent-containing resin particles with particle diameter not smaller than 16 μm in an amount of substantially 0% by weight, where the % by number (N) of coloring agent-containing resin particles with particle diameters of 6.35 to 10.1 μm was 48% by number and the % by weight (V) of coloring agent-containing resin particles with particle diameters of 6.35 to 10.1 μm was 63% by weight. Therefore the particle size distribution:

$$\frac{V\times\bar{d}4}{N}$$

of the cyan toner was 9.8.

As a carrier, a resin-coated carrier comprised of Cu-Zn-Fe (15:15:70) magnetic ferrite carrier cores coated with 0.5% by weight of a styrene resin was used. This magnetic ferrite carrier cores had a weight average particle diameter of 45 μm, and contained particles with particle diameters not larger than 35 μm in an amount of 4.2% by weight, particles with particle diameters of 35 to 40 μm in an amount of 9.5% by weight, particles with particle diameters of 40 to 74 μm in an amount of 86.1% by weight and particles with particle diameters not smaller than 74 μm in an amount of 0.2% by weight. The styrene resin used was a styrene/methyl methacrylate copolymer (copolymerization weight ratio: 80:20). Using a mixed solvent of xylene and methyl ethyl ketone, the Cu-Zn-Fe magnetic ferrite carrier cores were coated with the styrene resin. The styrene/methyl methacrylate copolymer had a volume resistivity of $5\times10^{14}\Omega\cdot$cm, and was in a coating weight of 0.5% by weight.

The particles (average particle diameter: 60 mμ) of the styrene/methyl methacrylate copolymer used in the coat and the Cu-Zn-Fe magnetic ferrite carrier cores were blended to measure the quantity of triboelectricity. As a result, the quantity of triboelectricity A μc/g in an environment of temperature 15° C. and humidity 10% RH was −120 μc/g, and the quantity of triboelectricity B μc/g in an environment of temperature 30° C. and humidity 80% RH was −35 μc/g.

Next, 5 parts by weight of the toner and 100 parts by weight of the resin-coated ferrite carrier were blended. A two-component developer was thus prepared.

This two-component developer was applied in a commercially available plain-paper color copier (Color Laser Copier 500, manufactured by Canon Inc.), and an image was reproduced in an environment of 23° C./65% RH, setting development contrast at 300 V. The toner image thus obtained was in an image density of as high as 1.50, free from fog, and sharp. Copies were further taken on 10,000 sheets, during which density decreased by as small as 0.05 and the same fog-free, sharp images as those at the initial stage were obtained. In an environment of low temperature and low humidity (20° C., 10% RH), images were reproduced setting the development contrast at 300 V. As a result, image density was as high as 1.50, showing that the quantity of triboelectricity was effectively controlled in an environment of low humidity.

In an environment of high temperature and high humidity (30° C., 80% RH), images were reproduced setting the development contrast at 300 V. As a result, image density was 1.40 and very stable and good toner images were obtained.

Image reproduction was also tested after the developer was left to stand for 1 month in each environment of 23° C./60% RH, 20° C./10% RH and 30° C./80% RH. As a result, no undesirable changes were seen also in initial images.

EXAMPLE 15

| | |
|---|---|
| Polyester resin obtained by condensation of propoxylated bisphenol and fumaric acid (weight average molecular weight: about 17000) | 100 parts |
| Phthalocyanine pigment | 4 parts |
| Chromium complex of di-tert-butylsalicylic acid | 2 parts |

The above materials were preliminarily thoroughly mixed using a Henschel mixer, and then melt-kneaded at least twice using a three-roll mill. After cooled, the kneaded product was crushed using a hammer mill to give coarse particles of about 1 to 2 mm in diameter, which were then finely pulverized using a fine grinding mill of an air-jet system. The resulting finely pulverized product was then classified using a multi-division classifier and particles with particle diameters of 2 to 10 μm were mainly collected. Resin particles containing a coloring agent were thus obtained.

A cyan toner was prepared by blending 100 parts of the above coloring agent-containing resin particles, 0.5 part of hydrophobic fine titanium oxide powder, and 0.5 part of acrylic resin particles comprised of methyl methacrylate, having a volume resistivity of $3\times10^{10}\Omega\cdot$cm and having two peaks at particle diameters of 53 mμ and 550 mμ in their particle size distribution.

The cyan toner thus prepared had a weight average particle diameter ($\bar{d}4$) of 8.2 μm, contained coloring agent-containing resin particles with particle diameters not larger than 5 μm in an amount of 31% by number, contained coloring agent-containing resin particles with particle diameters of 12.7 to 16 μm in an amount of 1.7% by weight, and contained coloring agent-containing resin particles with particle diameter not smaller than 16 μm in an amount of substantially 0% by weight, where the % by number (N) of coloring agent-containing resin particles with particle diameters of 6.35 to 10.1 μm was 46% by number and the % by weight (V) of coloring agent-containing resin particles with particle diameters of 6.35 to 10.1 μm was 64% by weight. Therefore the particle size distribution:

$$\frac{V\times\bar{d}4}{N}$$

of the cyan toner was 11.1.

This toner was applied in a commercially available color copier (CLC-500; manufactured by Canon Inc.) whose developing assembly had been so modified as to have the constitution shown in FIG. 2, and images were reproduced. The surface layer of the developer carrying member 2 of the developing assembly was formed of a coat sleeve (coat layer thickness: 10 μm) coated with a phenol resin composition wherein 40 parts of crystalline graphite was dispersed in 100 parts of a phenol resin. The urethane spongy roller 4 was also provided. The developer coating blade 5 was provided in contact with the developer carrying member at a linear pressure of 50 g/mm.

The latent image bearing member (photosensitive drum) 1 was comprised of an organic photoconductor (OPC) photosensitive drum having a surface layer comprising polycarbonate containing 20% by weight of polytetrafluoroethylene powder (Lubroni L-2; available from Daikin Industries, Ltd.).

As conditions for development, a development contrast was set to 350 V, the clearance between the developer carrying member and latent image bearing member was adjusted to 300 μm, a developing bias overlaid with an alternating electric field of 1.8 kHz and 1.5 kVpp was applied, and running tests were carried out on 5,000 sheets in each environment of 20° C./10% RH, 23° C./60% RH and 30° C./80% RH.

As a result, none of the toner fusion onto the photosensitive drum, the filming, the contamination of the developing sleeve surface and the adhesion of toner to the developing sleeve surface were seen, and stable, fog-free and sharp toner images were obtained in image densities of 1.40 to 1.50.

Image reproduction was also tested after the toner was left to stand for 1 month in each environment of 23° C./60% RH, 20° C./10% RH and 30° C./80% RH. As a result, no undesirable changes were seen also in initial images.

EXAMPLE 16

A toner was prepared in the same manner as in Example 15 except that 0.5 part of the acrylic resin particles as used in Example 15 and 0.5 part of fine silica powder (BET specific surface area: 230 $m^2/g$) having been treated with hexamethyldisilazane were used as additives. Images were also reproduced in the same manner as in Example 15. As a result, toner images were obtained in image densities of 1.35 to 1.45 in an environment of 20° C./10% RH, image densities of 1.45 to 1.55 in an environment of 23° C./65% RH, and image densities of 1.50 to 1.65 in an environment of 30° C./80% RH. Although environment characteristics were slightly lower than those in Example 15, good results were obtained.

EXAMPLE 17

Image reproduction was tested in the same manner as in Example 15 except for use of an OPC photosensitive drum having a surface layer comprising polymethyl methacrylate containing 12% by weight of polytrifluorochloroethylene powder (Daiflon; available from Daikin Industries, Ltd.). As a result, good results were obtained.

COMPARATIVE EXAMPLE 8

A toner was prepared in the same manner as in Example 15 except that acrylic resin particles having a peak only at a particle diameter of 49 mμ, obtained by disintegrating acrylic resin particles using a mechanical grinding mill were used. Images were also reproduced in the same manner as in Example 15. As a result, images were formed in the same image densities as in Example 15, but uneven toner images came to appear at halftone areas after running on about 3,000 sheets in an environment of 20° C./10% RH. The part corresponding thereto on the photosensitive drum surface was examined to reveal that a talc component contained in transfer paper was adhered, where faulty cleaning was seen to have occurred.

COMPARATIVE EXAMPLE 9

The acrylic resin particles as used in Example 15 was heat-treated to prepare acrylic resin particles having a peak at a particle diameter of 650 mμ. Using this acrylic resin particles, a toner was prepared. Images were reproduced in the same manner as in Example 15. As a result, a good cleaning performance was achieved, but the image densities became lower from 1.40 at the initial stage to 1.20 on 5,000 sheet running in an environment of 20° C./10% RH.

COMPARATIVE EXAMPLE 10

A toner was prepared in the same manner as in Example 15 except that the acrylic resin particles were not used. Images were reproduced in the same manner as in Example 15. As a result, fog occurred on about 1,000 sheet running in an environment of 20° C./10% RH and also low image densities resulted.

COMPARATIVE EXAMPLE 11

A toner was prepared in the same manner as in Example 16 except that the acrylic resin particles were not used. Images were reproduced in the same manner as in Example 16. As a result, images were formed in image densities of 1.25 to 1.35 in an environment of 20° C./10% RH and image densities of 1.60 to 1.70 in an environment of 30° C./80% RH, showing low environment characteristics. On about 5,000 sheet running, toner fusion had occurred on the surface of the photosensitive drum.

EXAMPLE 18

| | |
|---|---|
| Polyester resin obtained by condensation of propoxylated bisphenol and fumaric acid (weight average molecular weight: about 17000) | 100 parts |
| Phthalocyanine pigment | 4 parts |
| Chromium complex of di-tert-butylsalicylic acid | 2 parts |

The above materials were preliminarily thoroughly mixed using a Henschel mixer, and then melt-kneaded at least twice using a three-roll mill. After cooled, the kneaded product was crushed using a hammer mill to give coarse particles of about 1 to 2 mm in diameter, which were then finely pulverized using a fine grinding mill of an air-jet system. The resulting finely pulverized product was classified and particles with particle diameters of 2 to 10 μm were mainly collected. Resin particles containing a coloring agent were thus obtained.

A cyan toner was prepared by blending 100 parts by weight of the above coloring agent-containing resin particles, 0.5 part by weight of fine titanium oxide powder, and 0.5 part of acrylic resin particles produced from methyl methacrylate, having two peaks at particle diameters of 45 mμ and 550 mμ in their particle size distribution, containing the larger-diameter particles in an amount of 9% by weight and having a volume resistivity of $3\times10^{10}\Omega\cdot$cm.

The cyan toner thus prepared had a weight average particle diameter ($\overline{d}4$) of 8.4 μm, contained coloring agent-containing resin particles with particle diameters not larger than 5 μm in an amount of 27% by number, contained coloring agent-containing resin particles with particle diameters of 12.7 to 16 μm in an amount of 2.5% by weight, and contained coloring agent-containing resin particles with particle diameter not smaller than 16 μm in an amount of substantially 0% by weight, where the % by number (N) of coloring agent-containing resin particles with particle diameters of 6.35 to 10.1 μm was 49% by number and the % by weight (V) of coloring agent-containing resin particles with particle diameters of 6.35 to 10.1 μm was 69% by weight. Therefore the particle size distribution:

$$\frac{V\times\overline{d}4}{N}$$

of the cyan toner was 11.8.

This toner was applied in a commercially available color copier (CLC-500; manufactured by Canon Inc.) whose developing assembly had been so modified as to have the constitution shown in FIG. 2, and images were reproduced. The surface layer of the developer carrying member 2 of the developing assembly was formed of a coat sleeve (coat layer thickness: 10 μm) coated with a phenol resin composition wherein 40 parts of crystalline graphite was dispersed in 100 parts of a phenol resin. The urethane spongy roller 4 was also provided. The developer coating blade 5 was provided in contact with the developer carrying member at a linear pressure of 50 g/mm.

As conditions for development, a development contrast was set to 350 V, the clearance between the developer carrying member and latent image bearing member was adjusted to 300 μm, a developing bias overlaid with an alternating electric field of 1.8 kHz and 1.5 kVpp was applied, and running tests were carried out on 5,000 sheets in each environment of 20° C./10% RH, 23° C./60% RH and 30° C./80% RH.

As a result, none of the toner fusion onto the photosensitive drum, the filming, the contamination of the developing sleeve surface and the adhesion of toner to the developing sleeve surface were seen, and stable, fog-free and sharp toner images were obtained in image densities of 1.42 to 1.50.

Image reproduction was also tested after the toner was left to stand for 1 month in each environment of 23° C./60% RH, 20° C./10% RH and 30° C./80% RH. As a result, no undesirable changes were seen also in initial images.

Binder Resing Preparation Example

| - First-stage Polymerization - | |
|---|---|
| Styrene | 370 parts |
| n-Butyl acrylate | 200 parts |
| Acrylic acid | 30 parts |
| Polymerization initiator represented by the structural formula (I) | 60 parts |
| 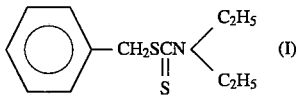 (I) | |
| Toluene | 500 parts |

The above materials were put in a reaction vessel made of glass, and its inside was sufficiently substituted with nitrogen. The reaction vessel was then hermetically stoppered. An ultraviolet lamp of 400 W was placed at a distance of 15 cm from the reaction vessel, where the reaction was carried out for 15 hours.

After completion of the reaction, part of the resultant mixture was collected, and its molecular weight was measured by GPC to confirm that a polymer with a number average molecular weight (Mn) of 2,300 and a weight average molecular weight (Mw) of 5,300 was obtained. Thereafter, a second-stage polymerization was carried out in the following way to give an AB-type block copolymer.

| - Second-stage Polymerization- | |
|---|---|
| Polymer produced in the first stage | 300 parts |
| Styrene | 465 parts |
| n-Butyl acrylate | 90 parts |
| Acrylic acid | 45 parts |
| Toluene | 1,000 parts |

After these were mixed and dissolved, polymerization was carried out by ultraviolet irradiation for 15 hours under the same conditions as the above using the polymerization initiator possessed by the polymer.

After completion of the reaction, the copolymer produced was re-precipitated and purified using hexane, followed by drying under reduced pressure. This copolymer was confirmed by GPC to have an Mn of 6,100 and an Mw of 12,500. It also had a glass transition point (Tg) of 55.0. The AB-type block copolymer thus obtained is designated as resin "a".

Subsequently, resins "b" and "c" were synthesized changing the amount of the polymerization initiator and the polymerization ratio of styrene, n-butyl acrylate and acrylic acid. Physical properties of these resins "a", "b" and "c" are shown in Table 2.

TABLE 2

| | Acrylic acid units in block copolymer (% by weight) | | (AB) n-type block copolymer Molecular weight | | | Tg |
|---|---|---|---|---|---|---|
| Resin | Segment-A | Segment-B | Mn | Mw | n | (°C.) |
| a | 1.5 | 5.0 | 6,100 | 12,500 | 1 | 55.0 |
| b | 7.5 | 0 | 6,400 | 13,000 | 1 | 56.5 |
| c | 5.0 | 5.0 | 13,000 | 27,000 | 1 | 61.2 |

EXAMPLE 19

| | |
|---|---|
| Resin "a" of the binder resin synthesis example | 100 parts |
| Chromium complex of di-tert-butylsalicylic acid | 2 parts |
| Carbon black (average particle diameter: 68 mμ; surface area: 20 $m^2/g$; oil absorption: 76 cc/100 g; pH: 6.0) | 4 parts |

The above materials were preliminarily thoroughly mixed using a Henschel mixer, and then melt-kneaded using a twin-screw extruder type kneader. After cooled, the kneaded product was crushed using a hammer mill to give coarse particles of about 1 to 2 mm in diameter, which were then finely pulverized using a fine grinding mill of an air-jet system. The resulting finely pulverized product was then classified to give a non-magnetic coloring agent-containing resin particles.

A black toner was prepared by blending 100 parts of the above coloring agent-containing resin particles, 0.3 part of acrylic resin particles comprised of a styrene/methyl methacrylate copolymer, having peaks at particle diameters of 53 mμ and 500 mμ in their particle size distribution and having a volume resistivity of $3\times10^{14}\Omega\cdot$cm, and 0.5 part of a hydrophilic fine titanium oxide powder with a BET specific surface area of 70 $m^2/g$. This black toner has a weight average particle diameter ($\bar{d}4$) of 8.0 μm, contained coloring agent-containing resin particles with particle diameters not larger than 5 μm in an amount of 27% by number, contained coloring agent-containing resin particles with particle diameters of 12.7 to 16 μm in an amount of 0.9% by weight, and contained coloring agent-containing resin particles with particle diameter not smaller than 16 μm in an amount of substantially 0% by weight, where the % by number (N) of coloring agent-containing resin particles with particle diameters of 6.35 to 10.1 μm was 58.2% by number and the % by weight (V) of coloring agent-containing resin particles with particle diameters of 6.35 to 10.1 μm was 82.2% by weight. Therefore the particle size distribution:

$$\frac{V\times\bar{d}4}{N}$$

of the black toner was 11.7.

As a carrier, a resin-coated carrier comprised of Cu-Zn-Fe (15:15:70) magnetic ferrite carrier cores coated with 0.5% by weight of a styrene resin was used. This magnetic ferrite carrier cores had a weight average particle diameter of 45 μm, and contained particles with particle diameters not larger than 35 μm in an amount of 4.2% by weight, particles with particle diameters of 35 to 40 μm in an amount of 9.5% by weight, particles with particle diameters of 40 to 74 μm in an amount of 86.1% by weight and particles with particle diameters not smaller than 74 μm in an amount of 0.2% by weight. The styrene resin used was a styrene/methyl methacrylate/2-ethylhexyl acrylate copolymer (copolymerization weight ratio: 50:20:30; number average molecular weight: 21,250; weight average molecular weight: 52,360).

Next, 5 parts by weight of the black toner and 100 parts by weight of the resin-coated ferrite carrier were blended. A two-component developer for black was thus prepared.

This two-component developer was applied in a commercially available plain-paper color copier (Color Laser Copier 200, manufactured by Canon Inc.), and an image was reproduced in an environment of 23° C./65% RH, setting development contrast at 300 V. The toner image thus obtained was in an image density of as high as 1.51, free from fog, and sharp. Copies were further taken on 10,000 sheets, during which density decreased by as small as 0.1 and the same fog-free, sharp images as those at the initial stage were obtained. In an environment of low temperature and low humidity (20° C., 10% RH), images were reproduced setting the development contrast at 320 V. As a result, image density was as high as 1.48, showing that the quantity of triboelectricity was effectively controlled in an environment of low humidity.

In an environment of high temperature and high humidity (30° C., 80% RH), images were reproduced setting the development contrast at 270 V. As a result, image density was 1.55 and very stable and good toner images were obtained.

Image reproduction was also tested after the developer was left to stand for 1 month in each environment of temperature 23° C./humidity 60% RH, temperature 20° C./humidity 10% RH and temperature 30° C./humidity 80% RH. As a result, no undesirable changes were seen also in initial images.

EXAMPLE 20

A toner and a developer were prepared in the same manner as in Example 19 except that as an additive the hydrophilic fine titanium oxide powder with a BET specific surface area of 70 $m^2/g$ used in Example 19 was replaced with a hydrophilic fine aluminum oxide powder with a BET specific surface area of 120 $m^2/g$ prepared by the gaseous phase process. Images were also reproduced in the same manner as in Example 19. As a result, image densities were 1.6 to 1.65 in an environment of 30° C./80% RH. Although the image densities were slightly higher than those in Example 19, good results were obtained.

EXAMPLES 21 AND 22

Toners and developers were prepared in the same manner as in Example 19 except that the binder resin was changed to resins "b" and "c", respectively. Image reproduction was tested in the same manner as in Example 19. Results obtained are shown in Table 3.

TABLE 3

| | | | | | Image density | |
|---|---|---|---|---|---|---|
| Example | Resin | (1) | (2) | Fog | 20° C./ 10% RH | 30° C./ 80% RH |
| 21 | b | 0.14 | 10,000 sh. Good | Good | 1.47 | 1.53 |
| 22 | c | 0.12 | 10,000 sh. Good | Good | 1.48 | 1.55 |

(1): Density variation after 10,000 sheet running
(2): Number of copied sheets/Offset resistance to fixing roller.

EXAMPLE 23

A toner and a developer were prepared in the same manner as in Example 19 except that 0.5 part of the acrylic resin particles as used in Example 19 and 0.5 part of fine silica powder (BET specific surface area: 170 $m^2/g$) having been treated with dimethyldichlorosilane were used as additives. Images were also reproduced in the same manner as in Example 19. As a result, toner images were obtained in image densities of 1.15 to 1.21 in an environment of 20° C./10% RH, image densities of 1.36 to 1.41 in an environment of 23° C./65% RH, and image densities of 1.58 to 1.61 in an environment of 30° C./80% RH. The environment characteristics were slightly lower than those in Example 19.

EXAMPLE 24

A toner and a developer were prepared in the same manner as in Example 19 except that carbon black with an average particle diameter of 65 mμ, a BET specific surface area of 20 $m^2/g$, an oil absorption of 73 cc/100 g-DBP and pH 6.0 was used as a coloring agent. Images were also reproduced in the same manner as in Example 19. As a result, toner images were obtained in image densities of 1.38 to 1.40 in an environment of 23° C./65% RH, image densities of 1.29 to 1.35 in an environment of 20° C./10% RH, and image densities of 1.43 to 1.48 in an environment of 30° C./80% RH. Although environment characteristics were slightly lower than those in Example 19, good results were obtained.

COMPARATIVE EXAMPLE 12

The acrylic resin particles as used in Example 19 were sufficiently disintegrated using a pulverizer of an air-jet system to prepare acrylic resin particles having one peak at a particle diameter of 50 mμ. A toner and a developer were prepared in the same manner as in Example 19 except that this acrylic resin particles thus obtained were used. Images were also reproduced in the same manner as in Example 19. Uneven images were slightly seen at halftone areas after running on about 1,000 sheets in an environment of 30° C./80% RH. As a result of confirmation, a low-resistance product contained in paper dust was adhered to the surface of the photosensitive drum, where faulty cleaning was seen to have occurred.

EXAMPLE 25

| | |
|---|---|
| Resin "a" of the binder resin synthesis example | 100 parts |
| Chromium complex of di-tert-butylsalicylic acid | 4.0 parts |
| Copper phthalocyanine pigment | 5.0 parts |

The above materials were melt-kneaded using a roll mill. After cooled, the kneaded product was crushed, pulverized and then classified to give resin particles containing a coloring agent.

A cyan toner was prepared by blending 100 parts of the above coloring agent-containing resin particles, 0.3 part of styrene/methyl methacrylate type resin particles having peaks at particle diameters of 63 mμ and 500 mμ in their particle size distribution and having a volume resistivity of $3\times10^{12}\Omega\cdot$cm, and 0.5 part of a hydrophilic fine titanium oxide powder with a BET specific surface area of 70 $m^2/g$.

The cyan toner thus obtained had a weight average particle diameter ($\bar{d}4$) of 8.3 μm, contained coloring agent-containing resin particles with particle diameters not larger than 5 μm in an amount of 28% by number, contained coloring agent-containing resin particles with particle diameters of 12.7 to 16 μm in an amount of 1.7% by weight, and contained coloring agent-containing resin particles with particle diameter not smaller than 16 μm in an amount of substantially 0% by weight where the % by number (N) of coloring agent-containing resin particles with particle diameters of 6.35 to 10.1 μm was 46% by number and the % by weight (V) of coloring agent-containing resin particles with particle diameters of 6.35 to 10.1 μm was 62% by weight. Therefore the particle size distribution:

$$\frac{V\times\bar{d}4}{N}$$

of the cyan toner was 11.2.

As a carrier, a resin-coated carrier comprised of Cu-Zn-Fe (15:15:70) magnetic ferrite carrier cores coated with 0.5% by weight of a styrene resin was used. This magnetic ferrite carrier cores had a weight average particle diameter of 45 μm, and contained particles with particle diameters not larger than 35 μm in an amount of 4.2% by weight, particles with particle diameters of 35 to 40 μm in an amount of 9.5% by weight, particles with particle diameters of 40 to 74 μm in an amount of 86.1% by weight and particles with particle diameters not smaller than 74 μm in an amount of 0.2% by weight. The styrene resin used was a styrene/methyl methacrylate/2-ethylhexyl acrylate copolymer (copolymerization weight ratio: 50:20:30; number average molecular weight: 21,250; weight average molecular weight: 52,360).

Next, 5 parts by weight of the cyan toner and 100 parts by weight of the resin-coated ferrite carrier were blended. A two-component developer for cyan was thus prepared.

This two-component developer was applied in a commercially available plain-paper color copier (Color Laser Copier 500, manufactured by Canon Inc.), and an image was reproduced in an environment of 23° C./65% RH, setting development contrast at 270 V. The toner image thus obtained was in an image density of as high as 1.5, free from fog, and sharp. Copies were further taken on 10,000 sheets, during which density decreased by as small as 0.1 and the same fog-free, sharp images as those at the initial stage were obtained. In an environment of low temperature and low humidity (20° C., 10% RH), images were reproduced setting the development contrast at 320 V. As a result, image density was 1.48, suggesting that the toner and developer of the present invention was effective for the controlling of the quantity of triboelectricity in an environment of low humidity.

In an environment of high temperature and high humidity (temperature: 30° C.; humidity: 80% RH), images were reproduced setting the development contrast at 270 V. As a result, image density was 1.62 and very stable and good toner images were obtained.

Image reproduction was also tested after the developer was left to stand for 1 month in each environment of 23° C./60% RH, 20° C./10% RH and 30° C./80% RH. As a result, no undesirable changes were seen also in initial images.

No offset occurred even on 30,000 sheet running, and the toner image showed a very preferable light transmission also when an OHP film was used.

The toner was left to stand for a day in a hot-air dryer of 45° C. to examine its state of blocking, but the toner underwent no changes and maintained a good fluidity.

The magenta toner thus obtained had a weight average particle diameter ($\bar{d}4$) of 8.2 μm, contained coloring agent-containing resin particles with particle diameters not larger than 5 μm in an amount of 28% by number, contained coloring agent-containing resin particles with particle diameters of 12.7 to 16 μm in an amount of 2.3% by weight, and contained coloring agent-containing resin particles with particle diameter not smaller than 16 μm in an amount of substantially 0% by weight, where the % by number (N) of coloring agent-containing resin particles with particle diameters of 6.35 to 10.1 μm was 42% by number and the % by weight (V) of coloring agent-containing resin particles with particle diameters of 6.35 to 10.1 μm was 59% by weight. Therefore the particle size distribution:

$$\frac{V \times \bar{d}4}{N}$$

of the magenta toner was 11.5.

In the same manner as in Example 26, 30,000 sheet running was carried out using the CLC-500 copier in a monochromatic mode. As a result, no offset occurred on the fixing roller, and fog-free, good images were obtained. Blocking resistance was tested in the same manner as in Example 26 to obtain good results. The results are shown in Table 4.

TABLE 4

| Example | Resin | (1) | (2) | (3) | (4) | (5) | Image density 20° C./10% RH | 23° C./65% RH | 30° C./80% RH |
|---|---|---|---|---|---|---|---|---|---|
| 25 | a | 30,000/A | A | A | A | A | 1.48 | 1.51 | 1.62 |
| 26 | b | 30,000/A | A | A | A | A | 1.45 | 1.50 | 1.58 |
| 27 | a | 30,000/A | A | A | A | A | 1.50 | 1.61 | 1.66 |

(1): Number of copied sheets/Offset resistance to fixing roller.
(2): Color reproducibility
(3): Transport performance
(4): Light transmission properties
(5): Blocking resistance

EXAMPLE 26

Example 25 was repeated except that the binder resin was replaced with the binder resin "b". Results obtained are shown in Table 4.

EXAMPLE 27

| | |
|---|---|
| Resin "a" of the binder resin synthesis example | 100 parts |
| Quinacridone pigment | 5.0 parts |
| Chromium complex of di-tert-butylsalicylic acid | 2 parts |

The above materials were then melt-kneaded using a roll mill. After cooled, the kneaded product was crushed, pulverized and then classified to give resin particles containing a coloring agent.

A magenta toner was prepared by blending 100 parts of the above coloring agent-containing resin particles, 0.4 part of organic resin particles having peaks at particle diameters of 120 mμ and 670 mμ in their particle size distribution and having a volume resistivity of $5\times10^{13}\Omega\cdot$cm, and 0.4 part of a $Al_2O_3$ particles with a BET specific surface area of 180 $m^2/g$, obtained by the gaseous phase process.

Evaluation

A: Good

EXAMPLE 28

| | |
|---|---|
| Styrene/n-butyl acrylate copolymer (copolymerization weight ratio: 8:2; weight average particle diameter (Mw): 250,000) | 100 parts |
| Magnetic fine material powder (BET specific surface area: 8.6 $m^2/g$) | 60 parts |
| Negative charge control agent (monoazo dye chromium complex) | 1 part |
| Low-molecular weight polypropylene (Mw: 6,000) | 3 parts |

The above materials were melt-kneaded using a twin-screw extruder heated to 140° C., followed by cooling. The kneaded product thus cooled was crushed using a hammer mill, and the crushed product was pulverized using a jet mill. The pulverized product thus obtained was air-classified to give a magnetic colored resin particles (I) with a weight average particle diameter of 10 μm (classified powder, Tg: 60° C.).

A negatively chargeable magnetic toner was prepared by blending 100 parts of the above magnetic colored resin particles, 0.3 part of organic resin particles having two peaks at particle diameters of 50 mμ and 550 mμ in their particle size distribution, containing the smaller-diameter particles and larger-diameter particles in amounts of 93% by weight and 7% by weight, respectively, and having monomer composition of 85% of methyl methacrylate, 10% of styrene and 5% of n-butyl acrylate, and 0.5 part of a hydrophobic fine silica powder (BET specific surface area: 150 $m^2/g$).

This magnetic toner was applied in a commercially available copier (CLC-500, manufactured by Canon Inc.) having been so modified that the magnetic toner was applicable, and images were reproduced on 10,000 sheets in an environment of high temperature and high humidity (32.5° C., 85% RH), in an environment of low temperature and low humidity (15° C., 10% RH) and in an environment of normal temperature and normal humidity (23.5° C., 60% RH). As a result, image densities were as stable as 1.38 in the environment of temperature 15° C./humidity 10% RH, 1.36 in the environment of temperature 23.5° C./humidity 60% RH, and 1.36 in the environment of temperature 32.5° C./humidity 80% RH. It was possible to obtain sharp images free from density difference from the initial stage one, and also free from fog, without any faulty cleaning.

EXAMPLE 29

A toner was prepared in the same manner as in Example 28 except for use of the same organic resin particles but having peaks at particle diameters of 90 mμ and 620 mμ in their particle size distribution and containing the smaller-diameter particles and larger-diameter particles in amounts of 89% by weight and 11% by weight, respectively. Images were also reproduced in the same manner as in Example 28. As a result, image densities obtained were as stable as 1.35 in the environment of temperature 15° C./humidity 10% RH, 1.34 in the environment of temperature 23.5° C./humidity 60% RH, and 1.32 in the environment of temperature 32.5° C./humidity 85% RH, and also the same results as in Example 28 were obtained.

EXAMPLE 30

A toner was prepared in the same manner as in Example 28 except for use of the same organic resin particles but having monomer composition of 65% of methyl methacrylate and 35% of n-butyl acrylate, having peaks respectively at particle diameters of 65 mμ and 570 mμ in their particle size distribution and containing the smaller-diameter particles and larger-diameter particles in amounts of 90% by weight and 10% by weight, respectively. Images were also reproduced in the same mariner as in Example 28. As a result, image densities obtained were 1.38 in the environment of temperature 15° C./humidity 10% RH, 1.36 in the environment of temperature 23.5° C./humidity 60% RH, and 1.33 in the environment of temperature 32.5° C./humidity 85% RH, and also the same good results as in Example 28 were obtained.

COMPARATIVE EXAMPLE 13

A toner was prepared in the same manner as in Example 28 except that the organic resin particles were not used. Images were also reproduced in the same manner. As a result, the image density at the initial stage greatly changed, and also the image densities in the respective environments were unstable. Moreover, uneven images occurred on about 6,000 sheet running.

COMPARATIVE EXAMPLE 14

A toner was prepared in the same manner as in Example 28 except for use of organic resin particles having the same composition but having one peak at a particle diameter of 50 mμ and containing substantially no larger-diameter particles. Images were also reproduced in the same manner. As a result, uneven images occurred after running on about 7,000 sheets. The surface of the drum was examined upon completion of 10,000 sheet running to confirm that low-resistance matters contained in paper dust were adhered to its surface in a large number.

COMPARATIVE EXAMPLE 15

A toner was prepared in the same manner as in Example 28 except for use of organic resin particles having the same composition but having peaks at particle diameters of 48 mμ and 1,100 mμ and containing the smaller-diameter particles and larger-diameter particles in amounts of 60% by weight and 40% by weight, respectively. Images were also reproduced in the same manner. As a result, fog occurred in the running in the environment of temperature 15° C./humidity 10% RH.

We claim:

1. A toner for developing an electrostatic image comprising:

colored resin particles (A) containing a coloring agent or a magnetic powder, and a powdery additive;

wherein said powdery additive comprises organic resin particles-(B) having peaks, respectively, in a region of particle diameters of 20 mμ to 200 mμ and a region of particle diameters of 300 mμ to 800 mμ in their particle size distribution, and at least one component (C) in amounts from 0.3 to 2% by weight selected from the group consisting of fine titanium oxide powder, fine alumina powder and a hydrophobic fine silica powder, wherein the smaller diameter organic resin particles of particle diameters of 20 mμ to 200 mμ are contained in an amount of from 80% by weight to 93% by weight in said organic resin particles; and the larger diameter organic resin particles of particle diameters of 300 mμ to 800 mμ are contained in an amount of from 2% by weight to 20% by weight in said organic resin particles.

2. The toner according to claim 1, wherein said colored resin particles-(A) has a weight average particle diameter of from 4 μm to 15 μm.

3. The toner according to claim 1, wherein said colored resin particles-(A) comprises non-magnetic colored resin particles having a weight average particle diameter of from 6 μm to 10 μm.

4. The toner according to claim 1, wherein said colored resin particles-(A) comprises magnetic colored resin particles having a weight average particle diameter of from 5 μm to 10 μm.

5. The toner according to claim 1, wherein said organic resin particles-(B) has a volume resistivity of from $10^6\Omega\cdot cm$ to $10^{16}\Omega\cdot cm$.

6. The toner according to claim 1, wherein said organic resin particles-(B) has a triboelectric charge polarity reverse to the triboelectric charge polarity of said colored resin particles-(A).

7. The toner according to claim 1, wherein said organic resin particles-(B) is contained in an amount of from 0.1 part by weight to 5.0 parts by weight based on 100 parts by weight of said colored resin particles-(A).

8. The toner according to claim 1, wherein said organic resin particles-(B) have a particle size distribution in which the distribution having a peak in a region of particle diameters of 20 mμ to 200 mμ and the distribution having a peak in a region of particle diameters of 300 mμ to 800 mμ are clearly divided.

9. The toner according to claim 1, wherein said organic resin particles-(B) comprises particles obtained by polymerizing vinyl monomers or a mixture thereof by soap-free polymerization.

10. The toner according to claim 1, wherein said colored resin particles-(A) contains a polyester resin and a coloring agent, and has a negative triboelectric chargeability.

11. The toner according to claim 1, wherein said organic resin particles-(B) comprises particles of an acrylic resin.

12. The toner according to claim 11, wherein said acrylic resin comprises a homopolymer of acrylic monomers or a copolymer of an acrylic monomer and a styrene monomer.

13. The toner according to claim 1, wherein said powdery additive comprises the organic resin particles-(B) and the fine titanium oxide powder or the fine aluminum oxide powder.

14. The toner according to claim 13, wherein said fine titanium oxide powder has a BET specific surface area of from 30 $m^2/g$ to 200 $m^2/g$.

15. The toner according to claim 13, wherein said fine aluminum oxide powder has a BET specific surface area of from 30 $m^2/g$ to 200 $m^2/g$.

16. The toner according to claim 1, wherein said powdery additive comprises the organic resin particles-(B) and the hydrophobic fine silica powder.

17. The toner according to claim 1, wherein said colored resin particles-(A) contains a carbon black having an average primary particle size of from 50 mμ to 70 mμ, a surface area of from 10 $m^2/g$ to 40 $m^2/g$, an oil absorption of from 50 cc/100 g-DBP to 100 cc/100 g-DBP and a pH of from 6.0 to 9.0.

18. The toner according to claim 1, wherein said colored resin particles-(A) contains an (AB) block copolymer.

19. The toner according to claim 1, wherein said colored resin particles-(A) comprises non-magnetic colored resin particles;

said non-magnetic colored resin particles having a weight average particle diameter of 6 μm to 10 μm, and being those in which non-magnetic colored resin particles with particle diameters not larger than 5 μm are contained in an amount of 15 to 40% by number, those with particle diameters of 12.7 μm to 16.0 μm in an amount of 0.1 to 5.0% by weight, and those with particle diameters not smaller than 16 μm in an amount of not more than 1.0% by weight; and non-magnetic colored resin particles with particle diameters of 6.35 μm to 10.1 μm have a particle size distribution satisfying the following expression:

$$9 \leqq \frac{V \times \bar{d}4}{N} \leqq 14$$

wherein V represents % by weight of the non-magnetic colored resin particles with particle diameters of 6.35 μm to 10.1 μm; N represents % by number of the non-magnetic colored resin particles with particle diameters of 6.35 μm to 10.1 μm; and $\bar{d}4$ represents a weight average diameter of the non-magnetic colored resin particles.

20. The toner according to claim 1, wherein said colored resin particles-(A) comprise non-magnetic colored resin particles.

21. A developer for developing an electrostatic image, comprising:

a toner and a carrier;

said toner comprising colored resin particles-(A) containing a coloring agent or a magnetic powder, and a powdery additive;

wherein said powdery additive comprises organic resin particles-(B) having peaks, respectively, in a region of particle diameters of 20 mμ to 200 mμ and a region of particle diameters of 300 mμ to 800 mμ in their particle size distribution, and at least one component (C) in amounts from 0.3 to 2% by weight selected from the group consisting of fine titanium oxide powder, fine alumina powder and a hydrophobic fine silica powder, wherein the smaller diameter organic resin particles of particle diameters of 20 mμ to 200 mμ are contained in an amount of from 80% by weight to 93% by weight in said organic resin particles; and the larger diameter organic resin particles of particle diameters of 300 mμ to 800 mμ are contained in an amount of from 2% by weight to 20% by weight in said organic resin particles.

22. The developer according to claim 21, wherein said carrier has a weight average particle diameter of from 25 μm to 65 μm.

23. The developer according to claim 21, wherein said toner is contained in an amount of from 2% by weight to 10% by weight.

24. The developer according to claim 21, wherein said toner is contained in an amount of from 3% by weight to 9% by weight.

25. The developer according to claim 21, wherein said carrier comprises a resin-coated carrier.

26. The developer according to claim 21, wherein said carrier comprises a resin-coated magnetic ferrite carrier.

27. The developer according to claim 26, wherein said resin-coated magnetic ferrite carrier comprises a Cu-Zn-Fe magnetic ferrite core and an acrylic resin coat layer.

28. The developer according to claim 25, wherein said resin-coated carrier comprises a styrene-acrylic resin coat layer formed of from 5% by weight to 70% by weight of an acrylic monomer and from 95% by weight to 30% by weight of a styrene monomer.

29. The developer according to claim 21, wherein said colored resin particles-(A) has a weight average particle diameter of from 4 μm to 15 μm.

30. The developer according to claim 21, wherein said colored resin particles-(A) comprises non-magnetic colored resin particles having a weight average particle diameter of from 6 μm to 10 μm.

31. The developer according to claim 21, wherein said organic resin particles-(B) has a volume resistivity of from $10^6 \Omega \cdot cm$ to $10^{16} \Omega \cdot cm$.

32. The developer according to claim 21, wherein said organic resin particles-(B) has a triboelectric charge polarity reverse to the triboelectric charge polarity of said colored resin particles-(A).

33. The developer according to claim 21, wherein said organic resin particles-(B) is contained in an amount of from 0.1 part by weight to 5.0 parts by weight based on 100 parts by weight of said colored resin particles-(A).

34. The developer according to claim 21, wherein said organic resin particles-(B) have a particle size distribution in which the distribution having a peak in a region of particle diameters of 20 mμ to 200 mμ and the distribution having a peak in a region of particle diameters of 300 mμ to 800 mμ are clearly divided.

35. The developer according to claim 21, wherein said organic resin particles-(B) comprises particles obtained by polymerizing vinyl monomers or a mixture thereof by soap-free polymerization.

36. The developer according to claim 21, wherein said colored resin particles-(A) contains a polyester resin and a coloring agent, and has a negative triboelectric chargeability.

37. The developer according to claim 21, wherein said organic resin particles-(B) comprises particles of an acrylic resin.

38. The developer according to claim 37, wherein said acrylic resin comprises a homopolymer of acrylic monomers or a copolymer of an acrylic monomer and a styrene monomer.

39. The developer according to claim 21, wherein said powdery additive comprises the organic resin particles-(B) and the fine titanium oxide powder or the fine aluminum oxide powder.

40. The developer according to claim 39, wherein said fine titanium oxide powder has a BET specific surface area of from 30 $m^2/g$ to 200 $m^2/g$.

41. The developer according to claim 39, wherein said fine aluminum oxide powder has a BET specific surface area of from 30 m2/g to 200 m2/g.

42. The developer according to claim 21, wherein said powdery additive comprises the organic resin particles-(B) and the hydrophobic fine silica powder.

43. The developer according to claim 21, wherein said colored resin particles-(A) contains a carbon black having an average primary particle size of from 50 mμ to 70 mμ, a surface area of from 10 $m^2/g$ to 40 $m^2/g$, an oil absorption of from 50 cc/100 g-DBP to 100 cc/100 g-DBP and a pH of from 6.0 to 9.0.

44. The developer according to claim 21, wherein said colored resin particles-(A) contains an (AB) block copolymer.

45. The developer according to claim 21, wherein said colored resin particles-(A) comprises non-magnetic colored resin particles;

said non-magnetic colored resin particles having a weight average particle diameter of 6 μm to 10 μm, and being those in which non-magnetic colored resin particles with particle diameters not larger than 5 μm are contained in an amount of 15 to 40% by number, those with particle diameters of 12.7 μm to 16.0 μm in an amount of 0.1 to 5.0% by weight, and those with particle diameters not smaller than 16 μm in an amount of not more than 1.0% by weight; and non-magnetic colored resin particles with particle diameters of 6.35 μm to 10.1 μm have a particle size distribution satisfying the following expression:

$$9 \leqq \frac{V \times \bar{d}4}{N} \leqq 14$$

wherein V represents % by weight of the non-magnetic colored resin particles with particle diameters of 6.35 μm to 10.1 μm; N represents % by number of the non-magnetic colored resin particles with particle diameters of 6.35 μm to 10.1 μm; and $\bar{d}4$ represents a weight average diameter of the non-magnetic colored resin particles.

46. The developer according to claim 21, wherein said colored resin particles-(A) comprise non-magnetic colored resin particles.

47. An image forming method comprising the steps of:

forming a toner layer on a developer carrying member;

forming a developing zone between said developer carrying member and a latent image bearing member opposingly provided thereto;

while applying a bias voltage across said developer carrying member and said latent image bearing member, developing a latent image formed on said latent image bearing member by the use of a toner of the toner layer formed on said developer carrying member, to form a toner image; and transferring said toner image to a transfer medium;

said toner comprising colored resin particles-(A) containing a coloring agent or a magnetic powder, and a powdery additive;

wherein said powdery additive comprises organic resin particles-(B) having peaks, respectively, in a region of particle diameters of 20 mμ to 200 mμ and a region of particle diameters of 300 mμ to 800 mμ in their particle size distribution, and at least one component (C) in amounts from 0.3 to 2% by weight selected from the group consisting of fine titanium oxide powder, fine alumina powder and a hydrophobic fine silica powder, wherein the smaller diameter organic resin particles of particle diameters of 20 mμ to 200 mμ are contained in an amount of from 80% by weight to 93% by weight in said organic resin particles; and the larger diameter organic resin particles of particle diameters of 300 mμ to 800 mμ are contained in an amount of from 2% by weight to 20% by weight in said organic resin particles.

48. The image forming method according to claim 47, wherein said developer carrying member comprises a resin surface layer having a solid lubricant.

49. The image forming method according to claim 47, wherein said latent image bearing member comprises an organic photosensitive layer containing a fluorine resin powder.

50. The image forming method according to claim 47, wherein said latent image bearing member comprises an organic photosensitive layer containing a fluorine resin powder in an amount of from 5% by weight to 40% by weight.

51. The image forming method according to claim 47, wherein an alternating-current bias is applied to said developer carrying member.

52. The image forming method according to claim 51, wherein an alternating-current bias with a frequency f of from 200 Hz to 4,000 Hz and a peak-to-peak voltage Vpp of from 500 V to 3,000 V is applied to said developer carrying member.

53. The image forming method according to claim 47, wherein said toner is triboelectrically charged as a result of the friction between the toner and a coating blade or the surface of the developer carrying member.

54. The image forming method according to claim 47, wherein said colored resin particles-(A) has a weight average particle diameter of from 4 μm to 15 μm.

55. The image forming method according to claim 47, wherein said colored resin particles-(A) comprises non-magnetic colored resin particles having a weight average particle diameter of from 6 μm to 10 μm.

56. The image forming method according to claim 47, wherein said organic resin particles-(B) has a volume resistivity of from $10^6\Omega\cdot cm$ to $10^{16}\Omega\cdot cm$.

57. The image forming method according to claim 47, wherein said organic resin particles-(B) has a triboelectric charge polarity reverse to the triboelectric charge polarity of said colored resin particles-(A).

58. The image forming method according to claim 47, wherein said organic resin particles-(B) is contained in an amount of from 0.1 part by weight to 5.0 parts by weight based on 100 parts by weight of said colored resin particles-(A).

59. The image forming method according to claim 47, wherein said organic resin particles-(B) have a particle size distribution in which the distribution having a peak in a region of particle diameters of 20 mμ to 200 mμ and the distribution having a peak in a region of particle diameters of 300 mμ to 800 mμ are clearly divided.

60. The image forming method according to claim 47, wherein said organic resin particles-(B) comprises particles obtained by polymerizing vinyl monomers or a mixture thereof by soap-free polymerization.

61. The image forming method according to claim 47, wherein said colored resin particles-(A) contains a polyester resin and a coloring agent, and has a negative triboelectric chargeability.

62. The image forming method according to claim 47, wherein said organic resin particles-(B) comprises particles of an acrylic resin.

63. The image forming method according to claim 62, wherein said acrylic resin comprises a homopolymer of acrylic monomers or a copolymer of an acrylic monomer and a styrene monomer.

64. The image forming method according to claim 47, wherein said powdery additive comprises the organic resin particles-(B) and the fine titanium oxide powder or the fine aluminum oxide powder.

65. The image forming method according to claim 64, wherein said fine titanium oxide powder has a BET specific surface area of from 30 $m^2/g$ to 200 $m^2/g$.

66. The image forming method according to claim 64, wherein said fine aluminum oxide powder has a BET specific surface area of from 30 $m^2/g$ to 200 $m^2/g$.

67. The image forming method according to claim 47, wherein said powdery additive comprises the organic resin particles-(B) and the hydrophobic fine silica powder.

68. The image forming method according to claim 47, wherein said colored resin particles-(A) contains a carbon black having an average primary particle size of from 50 mμ to 70 mμ, a surface area of from 10 $m^2/g$ to 40 $m^2/g$, an oil absorption of from 50 cc/100 g-DBP to 100 cc/100 g-DBP and a pH of from 6.0 to 9.0.

69. The image forming method according to claim 47, wherein said colored resin particles-(A) contains an (AB) block copolymer.

70. The image forming method according to claim 47, wherein said colored resin particles-(A) comprises non-magnetic colored resin particles;

said non-magnetic colored resin particles having a weight average particle diameter of 6 μm to 10 μm, and being those in which non-magnetic colored resin particles with particle diameters not larger than 5 μm are contained in an amount of 15 to 40% by number, those with particle diameters of 12.7 μm to 16.0 μm in an amount of 0.1 to 5.0% by weight, and those with particle diameters not smaller than 16 μm in an amount of not more than 1.0% by weight; and non-magnetic colored resin particles with particle diameters of 6.35 μm to 10.1 μm have a particle size distribution satisfying the following expression:

$$9 \leqq \frac{V \times \bar{d}4}{N} \leqq 14$$

wherein V represents % by weight of the non-magnetic colored resin particles with particle diameters of 6.35 μm to 10.1 μm; N represents % by number of the non-magnetic colored resin particles with particle diameters of 6.35 μm to 10.1 μm; and $\bar{d}4$ represents a weight average diameter of the non-magnetic colored resin particles.

71. The image forming method according to claim 47, wherein said colored resin particles-(A) comprise non-magnetic colored resin particles.

* * * * *

UNITED STATES PATENT AND TRADEMARK OFFICE

CERTIFICATE OF CORRECTION

PATENT NO. : 5,620,824

DATED : April 15, 1997

INVENTOR(S) : KENJI OKADO, ET AL.

It is certified that error appears in the above-identified patent and that said Letters Patent is hereby corrected as shown below:

ON TITLE PAGE, AT ITEM [75], INVENTORS:
"Kanagawa-ken" should read --Kanagawa--.

ON TITLE PAGE, AT ITEM 57, ABSTRACT
Line 5, "particles" should read --particle--;
Line 7, "larger-diameters" should read --larger-diameter--.

COLUMN 3
Line 29, "the" should be deleted.

COLUMN 4
Line 6, "insufficient" should read --an insufficient--;
Line 8, "an" should be deleted.

COLUMN 6
Line 35, "such" should read --such that--;
Line 55, "additive," should read --additive--

COLUMN 8
Line 22, "region" should read --the region--.

COLUMN 9
Line 44, "particle" should read --particles--;
Line 49, "particle" should read --particles--.

COLUMN 10
Line 58, "in" should be deleted.

UNITED STATES PATENT AND TRADEMARK OFFICE

CERTIFICATE OF CORRECTION

PATENT NO. : 5,620,824

DATED : April 15, 1997

INVENTOR(S) : KENJI OKADO, ET AL.

It is certified that error appears in the above-identified patent and that said Letters Patent is hereby corrected as shown below:

COLUMN 11
Line 2, "timethylchlorosilane, tim-" should read --trimethylchlorosilane, trim---.

COLUMN 13
Line 23, "an" should read --a--;
Line 26, "have" should read --has--;
Line 67, "down" should read --reduction--.

COLUMN 14
Line 3, "tends" should read --tends to--.

COLUMN 17
Line 58, "with particle diameter" should be deleted.

COLUMN 18
Line 11, "present" should be deleted.

COLUMN 19
Line 62, "of;" should read --of:--.

COLUMN 20
Line 27, "has" should read --have--;
Line 28, "is" should read --are--;
Line 40, "an" should read --a--.

COLUMN 22
Line 45, "shaked" should read --shaken--;
Line 52, "apart" should read --part--.

UNITED STATES PATENT AND TRADEMARK OFFICE

CERTIFICATE OF CORRECTION

PATENT NO. : 5,620,824

DATED : April 15, 1997

INVENTOR(S) : KENJI OKADO, ET AL.

It is certified that error appears in the above-identified patent and that said Letters Patent is hereby corrected as shown below:

COLUMN 23
Line 17, "ture" should read --tured--.

COLUMN 24
Line 5, "monodisperse" should read --monodispersed--.

COLUMN 25
Line 15, "This" should read --These--.

COLUMN 27
Line 60, "This" should read --These--.

COLUMN 28
Line 58, "slightly" should read --slightly reduced--.

COLUMN 29
Line 64, "this" should read --these--;
Line 65, "was" should read --were--.

COLUMN 30
Line 16, "Became halfway unable to continue the test" should read --Failed halfway through the test--.

COLUMN 31
Line 36, "This" should read --These--.

COLUMN 32
Line 52, "Example 9" should read --Reference Example 9--.

UNITED STATES PATENT AND TRADEMARK OFFICE

CERTIFICATE OF CORRECTION

PATENT NO. : 5,620,824

DATED : April 15, 1997

INVENTOR(S) : KENJI OKADO, ET AL.

It is certified that error appears in the above-identified patent and that said Letters Patent is hereby corrected as shown below:

COLUMN 33
Line 12, "this" should read --these--;
Line 13, "was" should read --were--.

COLUMN 34
Line 31, "This" should read --These--.

COLUMN 37
Line 5, "was" should read --were--;
Line 7, "this" should read --these--.

COLUMN 38
Line 45, "Resing" should read --Resin--.

COLUMN 39
Line 62, "a" should be deleted.

COLUMN 40
Line 24, "This" should read --These--.

COLUMN 42
Line 49, "This" should read --These--.

COLUMN 43
Line 54, "2 parts" should read --2.0 parts--;
Line 66, "a" (first occurrence) should be deleted.

COLUMN 44
Line 65, "a" (first occurrence) should be deleted.

UNITED STATES PATENT AND TRADEMARK OFFICE

CERTIFICATE OF CORRECTION

PATENT NO. : 5,620,824

DATED : April 15, 1997

INVENTOR(S) : KENJI OKADO, ET AL.

It is certified that error appears in the above-identified patent and that said Letters Patent is hereby corrected as shown below:

COLUMN 45
Line 53, "mariner" should read --manner--.

COLUMN 46
Line 30, "particles (A)" should read --particles -(A)--.

COLUMN 49
Line 27, "30 m2/g to 200 m2/g." should read --30 $m^2$g to 200 $m^2$/g.

Signed and Sealed this

Twenty-seventh Day of January, 1998

*Attest:*

*Attesting Officer*

BRUCE LEHMAN

*Commissioner of Patents and Trademarks*